US006139279A

United States Patent [19]

Pearce et al.

[11] Patent Number: 6,139,279

[45] Date of Patent: Oct. 31, 2000

[54] SYSTEM FOR SUSPENDING A CEILING FAN

[75] Inventors: Richard A. Pearce, Memphis; Jose Maria D. Magno, Jr., Cordova, both of Tenn.

[73] Assignee: Hunter Fan Company, Memphis, Tenn.

[21] Appl. No.: 09/333,253

[22] Filed: Jun. 15, 1999

[51] Int. Cl.[7] ..... B63H 1/28

[52] U.S. Cl. ..... 416/244 R

[58] Field of Search ..... 416/5, 244 R, 416/246, 4; 248/317, 342, 343, 345; 403/22, 115, 116

[56] References Cited

U.S. PATENT DOCUMENTS

| | | | |
|---|---|---|---|
| 2,749,074 | 6/1956 | Bodian | 248/344 |
| 4,245,957 | 1/1981 | Savage et al. | 416/135 |
| 4,555,166 | 11/1985 | Enomoto | 350/634 |
| 4,729,725 | 3/1988 | Markwardt | 417/423 R |
| 4,836,806 | 6/1989 | Dougherty et al. | 439/751 |
| 4,854,562 | 8/1989 | de Fontenay et al. | 267/292 |
| 4,878,806 | 11/1989 | Markwardt | 416/5 |
| 4,884,947 | 12/1989 | Rezek | 416/5 |
| 4,936,533 | 6/1990 | Adams et al. | 248/222.1 |
| 5,033,722 | 7/1991 | Lammers | 267/153 |
| 5,090,654 | 2/1992 | Ridings et al. | 248/343 |
| 5,222,864 | 6/1993 | Pearce | 416/5 |
| 5,232,209 | 8/1993 | de Fontenay | 267/220 |
| 5,256,037 | 10/1993 | Chatelain | 417/423.7 |
| 5,267,805 | 12/1993 | Ueno et al. | 403/134 |
| 5,507,619 | 4/1996 | Ryan | 416/5 |
| 5,613,832 | 3/1997 | Su | 416/244 R |
| 5,641,133 | 6/1997 | Toosi | 244/17.27 |
| 5,651,535 | 7/1997 | David | 267/140.5 |
| 5,659,129 | 8/1997 | Asoyan et al. | 73/54.25 |
| 5,984,640 | 11/1999 | Wang | 416/244 R |
| 6,036,154 | 3/2000 | Pearce | 416/5 |

OTHER PUBLICATIONS

Richard A. Pearce, Co–pending concurrently filed and commonly assigned U.S. Patent Application Serial No. 09/333,616, entitled "System For Suspending A Ceiling Fan", filed Jun. 15, 1999, in its entirety.

*Primary Examiner*—Edward K. Look
*Assistant Examiner*—James M McAleenan
*Attorney, Agent, or Firm*—Garrison, Morris, Haight, PLLC

[57] ABSTRACT

A system for suspending a ceiling fan is provided which allows the ceiling fan to pivot, to accommodate vaulted or sloped ceilings, while preventing the ceiling fan from rotating about a longitudinal centerline axis of the fan. The system includes a hollow canopy defining an interior space and having an upper end portion, which is operatively attachable to a support structure such as the ceiling. The canopy further includes a lower end portion and a central, body portion extending between the upper and lower end portions. The canopy includes a seat which is connected to and extends upwardly from the lower end portion, and a guide which is also connected to the lower end portion and extends upwardly therefrom. The guide has an inner surface which forms a portion of the inner surface of the seat and defines a receptacle which extends through the seat and a bottom surface of the canopy. The seat defines an aperture which also extends through the bottom surface of the canopy. A ball is pivotally engaged with the canopy seat and is connected to a stationary portion of the ceiling fan. A pin is attached to the ball and protrudes radially outwardly from the outer surface of the ball, with the pin being engaged in the receptacle of the canopy guide. The pin has a longitudinal centerline axis which extends through a center of the outer surface of the ball and is substantially perpendicular to the longitudinal centerline axis of the ceiling fan. The ball and ceiling fan pivot about the centerline axis of the pin. The system may also include a hollow sleeve connected to the stationary portion of the ceiling fan, such as an upper end portion of a downrod of the ceiling fan. In this instance, the ball is disposed in surrounding relationship with the hollow sleeve and frictionally engages the sleeve.

24 Claims, 19 Drawing Sheets

SYSTEM FOR SUSPENDING A CEILING FAN

CROSS REFERENCES

This Application is related to co-pending, commonly assigned and concurrently filed U.S. Patent Application Ser. No. 09/333,616, entitled "System For Suspending A Ceiling Fan."

BACKGROUND

1. Field of the Invention

The present invention relates generally to ceiling fans and, more particularly, to a system for suspending a ceiling fan.

2. Related Art

Ceiling fans have become an increasingly popular supplementary means of conditioning air within both commercial and residential buildings. Notwithstanding the widespread use of ceiling fans, one continuing problem which faces ceiling fan designers is the tendency of ceiling fans to "wobble", or pivot about the point of suspension. Ceiling fan wobble may exist regardless of the type of conventional system used to mount the ceiling fan, due to fan blade imbalance, which may result from a variety of discrepancies associated with the ceiling fan blades including variations in blade pitch angle, dihedral angle, uneven circumferential spacing between adjacent blade pairs, blade warpage and uneven radial spacing of the blades from the vertical axis of rotation. However, ceiling fan wobble is more prevalent in ceiling fans suspended from a ceiling by a canopy and downrod arrangement, as subsequently discussed in greater detail. Ceiling fan wobble and the associated vibration creates undesirable noise, is visually distracting and may adversely affect the service life of the ceiling fan.

The fan blades of ceiling fans must be positioned at a certain optimum distance from the floor to achieve proper air circulation within the room in which they are installed. This may be accomplished in rooms having relatively high or vaulted ceilings by suspending the fan from the ceiling with a system which includes a canopy and downrod/ball assembly. While conventional systems of this type have enjoyed widespread use, they have a tendency to exacerbate the fan wobble problem as subsequently discussed in conjunction with FIGS. 1–7.

FIG. 1 is a fragmentary elevation view, partially in cross-section, illustrating a portion of a ceiling fan 10 and a conventional system 12 for suspending fan 10 from a ceiling (not shown). Ceiling fan 10 includes a motor (not shown) and a plurality of fan blades (not shown) connected to a rotatable portion of the motor, typically by blade irons (not shown). Ceiling fan 10 further includes a motor housing 14, which may have a unique configuration or decorative outer surface. The ceiling fan 10 typically includes a switch housing suspended below the motor housing 14 and may optionally include a light fixture. A stationary portion of the motor, such as the stator shaft (not shown) may be connected to the motor housing via an adapter 16, with the upper portion of adapter 16 being shown in FIG. 1. Adapter 16 is connected to the suspension system 12, for supporting the ceiling fan 10.

The suspension system 12 includes a hollow canopy 18 having an upper end portion 20 which is effective for mounting the ceiling fan directly to the ceiling or to an electrical junction box disposed above the ceiling. With regard to canopy 18, the upper end portion comprises an annular flange which may be attached to the ceiling or junction box via brackets (not shown). The suspension system 12 further includes a downrod 22 having a lower end which is attached to the adapter 16, typically by threading the lower end of the downrod 22 into adapter 16. The suspension system 12 further includes a ball 24 disposed in surrounding relationship with an upper end of the downrod 22 and connected thereto by a fastener, such as a set screw (not shown) extending radially through an annular wall of ball 24 into engagement with the downrod 22.

Canopy 18 defines an interior space 28 and includes a seat 30 extending upwardly from a lower end 32 of canopy 18 and defining an aperture 34 formed in the lower end 32. Seat 30 is discontinuous in a circumferential direction as subsequently explained further. The ball 24 is disposed partially within the interior space 28 defined by canopy 18, with a spherical outer surface 26 of ball 24 engaging an arcuate inner surface of the seat 30. As shown in FIG. 1, a portion of ball 24 extends through the aperture 34 and protrudes below the lower end 32 of canopy 18. The suspension system 12 further includes a pin 36 which extends through apertures 37 formed in the upper end of the downrod 22 and includes opposing ends 38, 40 which are disposed in longitudinally extending slots 42 formed in the ball 24. This permits the vertical suspension loads of the ceiling fan 10 to be reacted through the downrod 22, pin 36 and ball 24 to the canopy 18.

The spherical outer surface 26 of the ball 24 and the arcuate inner surface of the seat 30 of canopy 18 permits the ball 24 to pivot within seat 30 of canopy 32. Accordingly, the ceiling fan may pivot about the center of rotation of ball 24, corresponding to the center (indicated at G in FIGS. 3, 4, 5 and 7) of the spherical radius defining the outer surface of the ball 24. The foregoing pivoting of ball 24 and resultant pivoting of the ceiling fan 10, is necessary for the following reasons. In the first instance, ball 24 must be free to pivot when ceiling fan 10 is mounted to a vaulted, or sloped ceiling. In this instance, the design intent is that a longitudinal centerline axis 54 of the ceiling fan 10 remains substantially vertically disposed. Another reason for requiring the ball 24 to pivot within seat 30 of canopy 32, is to accommodate wobble of ceiling fan 10 due to an imbalance of the fan blades or rotating portion of the motor. Rigidly mounting the ceiling fan 10 to the ceiling (i.e., eliminating the pivoting motion of ball 24 within seat 30) would result in damage to the ceiling as a result of the ceiling fan wobble which typically occurs.

The canopy 18 further includes a radially extending tab 50 which engages a longitudinally extending slot 52 formed in the outer surface 26 of the ball 24. The tab 50 is located circumferentially at a position where the seat 30 of canopy 18 is discontinuous. Furthermore, as shown in FIG. 2, the tab 50 extends radially outward from the bottom end 32 of canopy 18. It is important to note that when the ceiling fan is at rest, with the ball 24 engaged in seat 30 of canopy 18 as shown in FIG. 1, the tab 50 of canopy 18 engages the slot 52 of ball 24 at a position which is below the center G of the spherical radius defining the outer surface of the ball 24. This causes the ball 24 to pivot about an axis which does not pass through the center G as subsequently discussed.

The engagement of the tab 50 in slot 52 of ball 24 reacts the rotational torque created by the motor of the ceiling fan 10 and prevents the ball 24 from rotating within seat 30 about a longitudinal centerline axis 54 of the fan 10. Accordingly, the ceiling fan 10 is prevented from rotating about the longitudinal centerline axis 54 of the ceiling fan 10. This prevents the electrical wires (not shown) which pass upward through the hollow interior of the downrod 22 to the junction box, from becoming entangled. However, the local pinning of the ball 24, via tab 50 in slot 52, causes the ball 24 to pivot within seat 30, in reaction to the motor torque, so that the centerline axis 54 is canted relative to vertical, during operation of the ceiling fan 10. Furthermore, the inventor has determined that as the ball 24 pivots within seat 30 of canopy 18 an undesirable rotation (less than one revolution) of the ball 24 and downrod 22 occurs in reaction to the motor torque. This motion is superimposed on the generally circular motion created by imbalances in the fan blades or other rotating components, which normally occurs. The partial rotation of the ball 24 and downrod 22, in reaction to the motor torque, exacerbates the ceiling fan wobble problem as further discussed in conjunction with FIGS. 3–7. Furthermore, it is believed that the partial rotation of the ball 24 and downrod 22 in reaction to the motor torque, creates a magnified, elliptical wobble pattern, which has been observed with ceiling fans having the type of suspension system discussed previously, rather than a circular fan wobble pattern.

When the ceiling fan 10 is energized, a rotational torque is applied to the ball 24 through the downrod 22. This rotational torque tends to rotate the ball 24 within seat 30 of canopy 32 about the center G of the spherical radius defining the outer surface of ball 24. However, since the ball is pinned at one location, by the engagement of tab 50 in slot 52, a secondary pivot point is established. As a result, the ball 24 pivots about an axis EF (shown in FIGS. 3,5 and 7) which passes through the center G of the spherical radius of the ball 24 and the location, indicated generally at H, where the tab 50 engages slot 52. This causes the centerline axis 54 of the ceiling fan 10 (which passes through the center of the downrod 22) to be canted, or disposed at an angle relative to vertical, during operation of the ceiling fan 10.

FIGS. 3–7 are provided in an attempt to further illustrate the complex motion of the ball 24, within the canopy seat 30, and the downrod 22 attached to the ball 24. As shown in FIG. 3, axis EF is oriented at an acute angle 56 relative to a horizontal axis 58 passing through the center G of the spherical radius defining the outer surface of ball 24. Axis EF is not perpendicular to the centerline axis 54 of the fan 10, but instead is disposed at an acute angle 60 from axis 54. Furthermore, the axis EF remains stationary as the ball 24 and downrod 22 move. Accordingly, the angle between axis EF and centerline 54 changes as the ball 24 and downrod 22 move. The inventor has determined that this orientation of axis EF relative to the centerline axis 54 of fan 10 is the reason that fan 10 becomes canted relative to vertical during operation.

A plane ABCD is illustrated in FIGS. 4–7 which passes longitudinally through the center of downrod 22 and intersects the axis EF passing between points G and H. In FIG. 6, plane ABCD is substantially vertically disposed and intersects an outer surface of the downrod 22 at points I and J which are horizontally aligned with one another. Ball 24 and downrod 22 may describe a first motion within plane ABCD as shown by direction arrow 56 in FIG. 4. Also, as discussed previously, the ball 24 and downrod 22 may pivot about the axis EF. When the ball 24 and downrod 22 are pivoted about axis EF to the position shown in FIGS. 4 and 5 points I and J on downrod 22 are displaced horizontally from one another by a distance X, as shown in FIG. 5. This displacement of points I and J is equivalent to that which would occur if the downrod 22 were rotated counterclockwise, as viewed from a position below fan 10, about the longitudinal centerline axis 54 of fan 10. When the ball 24 and downrod 22 are moved to the position shown in FIG. 7, it may be seen that points I and J on downrod 22 are displaced by a horizontal distance Y, which is equivalent to that which would occur if the downrod 22 were rotated in a clockwise direction, as viewed from a position below fan 10, about the longitudinal centerline axis 54 of the ceiling fan 10. The inventor has deduced that conversely, an attempt to rotate the downrod 22 and ball 24 about the longitudinal centerline axis 54 of fan 10, such as that caused by the application of the rotational torque of the motor of fan 10, causes the downrod 22 and ball 24 to pivot about axis EF such that the longitudinal axis 54 is canted or angled relative to vertical during the operation of fan 10. The inventor has observed that with conventional ceiling fans employing a suspension system such as that described with respect to FIGS. 1–7, the centerline of the ceiling fan, such as centerline 54, is in fact angled relative to vertical during operation of the fan resulting in an undesirable appearance. Furthermore, the circular motion created by any imbalance in the rotating parts of the ceiling fan, such as the fan blades, adds to and subtracts from the motion created by the torque of the ceiling fan motor such that the ceiling fan jerks during operation and describes an elliptical fan wobble pattern. The inventor has further determined that the magnitude of the angle that the centerline of the ceiling fan is displaced relative to vertical, increases as the motor torque increases. Since the current trend is to provide ceiling fans with increased motor torque, so as to produce an increase in the amount of air circulated by the fan, as measured in cfm, the foregoing problems associated with conventional ceiling fan suspension systems, represents an ever-increasing problem for ceiling fan designers.

Another problem associated with the use of conventional ceiling fan suspension systems of the type illustrated in FIGS. 1–7, is related to the use of the set screw, discussed previously, to attach the pivoting ball 24 to the downrod 22. The set screw tends to cause the downrod 22 to be off center relative to ball 24 somewhat, resulting in the centerline 54 of fan 10 to be canted related to vertical. Furthermore, if the set screw is improperly assembled, such that the downrod 22 is free to pivot somewhat relative to the ball 24, the ceiling fan wobble problem is exacerbated.

In view of the foregoing deficiencies with known systems for suspending ceiling fans, there remains a need for an improved system which alleviates ceiling fan wobble.

SUMMARY

In view of the foregoing needs, the present invention is directed to a system for suspending a ceiling fan having a longitudinal centerline axis, a motor having a rotor and a stator, and a plurality of fan blades connected to the rotor. Although the system of the present invention may be advantageously utilized with any ceiling fan, the system of the present invention is particularly useful in suspending ceiling fans having a downrod to locate the ceiling fan blades at the proper position within rooms having high or vaulted ceilings. The system is configured so that the ceiling fan is free to pivot, about an axis which remains substantially perpendicular to the longitudinal centerline axis of the ceiling fan, in order to accommodate vaulted ceilings. Additionally, the system is configured to prevent the rotation of the ceiling fan about the longitudinal centerline axis, in order to prevent the electrical wires controlling the operation of the fan, from becoming entangled during operation. Since the pivot axis always remains substantially perpendicular to the longitudinal centerline axis of the ceiling fan, the ceiling fan may remain in a vertical plane during operation of the fan, and is not canted relative to vertical due to reaction of the operational torque of the ceiling fan motor, unlike the conventional ceiling fan suspension systems commonly used previously. Accordingly, use of the system for suspending a ceiling fan according to the present invention results in an improvement in ceiling fan wobble relative to that experienced with fans suspended with conventional systems, such as that discussed in the Background herein.

According to one embodiment, the system for suspending a ceiling fan according to the present invention includes a hollow canopy which defines an interior space and includes an upper end portion which is operatively attachable to a support structure. The canopy further includes a lower end portion having a bottom surface and a seat connected to the lower end portion and extending upwardly from the bottom surface within the interior space. The seat has upper and lower ends, an outer surface and an inner surface defining an aperture extending through the seat and through the bottom surface of the lower end portion. The canopy further includes a guide connected to and extending upwardly from the lower end portion within the interior space. The guide has an inner surface which forms a portion of the inner surface of the seat and the guide defines a receptacle which extends through the seat. The receptacle of the guide extends to, and may extend through, the bottom surface of the lower end portion of the canopy.

In one embodiment, the canopy seat and guide are made as a one-piece construction with the remainder of the canopy. In this embodiment, the canopy is preferably made of a material selected from the group consisting of metals and metallic alloys. In another embodiment, the canopy seat and guide are manufactured separately from the remainder of the canopy, which includes the upper and lower end portions and a central, body portion extending therebetween. In this embodiment, the upper and lower end portions, as well as the central, body portion of the canopy are made from a material selected from the group consisting of metals and metallic alloys, while the seat and guide of the canopy are preferably made from a molded plastic or from a metal such as cast zinc. The seat and guide are then attached, preferably by bonding, to the lower end portion of the canopy.

The system further includes a ball pivotally engaged with the canopy seat and connected to a stationary portion of the ceiling fan for the purpose of suspending the ceiling fan. The ball has upper and lower ends, and inner and outer surfaces which define an annular wall extending between the upper and lower ends. The inner surface is connected to the stationary portion of the ceiling fan, while the outer surface engages the inner surface of the seat of the canopy.

A pin is attached to the ball and protrudes radially outwardly from the outer surface of the ball, with the pin being engaged with the receptacle of the guide of the canopy. The pin and guide receptacle cooperate with one another to prevent the ball and the ceiling fan from rotating about the longitudinal centerline axis of the fan. Additionally, the outer surface of the ball and the inner surface of the canopy seat have complimentary shapes and interact with one another to allow the ceiling fan to pivot about the longitudinal centerline axis of the pin. An important feature of the present invention is that the longitudinal centerline axis of the pin remains substantially perpendicular to the longitudinal centerline axis of the fan, regardless of the position of the ball relative to the canopy seat, such that the ceiling fan may remain in a substantially vertical disposed plane during operation of the fan.

The pin and the ball may either comprise a one-piece construction, or may be made separately from one another, with the pin being attached to the ball. In one preferred embodiment, both the pin and ball are made from a nylon material. However, in other embodiments, the pin and ball may be made from plastic materials, such as ABS, or may be made from various metals or metallic alloys such as steel.

The system for suspending a ceiling fan according to the present invention has particular application with regard to ceiling fans which include a downrod having upper and lower ends, with the lower end being connected to a stationary portion of the ceiling fan, such as the motor housing surrounding the ceiling fan motor. In this instance, according to a preferred embodiment of the present invention, the system further includes a hollow sleeve having open upper and lower ends, with the sleeve being disposed in surrounding relationship with and connected to the upper end of the downrod of the ceiling fan. The sleeve has a substantially cylindrical inner surface and a tapered outer surface. In this embodiment, the ball is disposed in surrounding relationship with the sleeve. The inner surface of the ball defines an aperture extending through the ball which is effective for receiving the sleeve, with the inner surface of the ball being configured to frictionally engage the tapered outer surface of the sleeve. Both the inner surface of the ball and the outer surface of the hollow sleeve are tapered radially outwardly between the lower and upper ends of the ball and sleeve, respectively. The inner surface of the ball has a radially outward taper, preferably ranging from about 1.0 degrees to about 15.0 degrees relative to the longitudinal centerline axis of the ball. Similarly, the outer surface of the hollow sleeve has a radially outward taper which preferably ranges from about 1.0 degrees to about 15.0 degrees relative to the longitudinal centerline axis of the sleeve. The taper of both the outer surface of the sleeve and the inner surface of the ball may be about 7.0 degrees.

In this embodiment, the system further includes a pin which is effective for connecting the hollow sleeve to the upper end of the ceiling fan downrod which includes a pair of diametrically opposed holes extending radially therethrough. The hollow sleeve includes a pair of diametrically opposed apertures extending through an annular wall defined between the inner and outer surface of the hollow sleeve. The sleeve is positioned so that the apertures in the sleeve are aligned with the holes in the upper end of the downrod and the pin is inserted through the apertures in the hollow sleeve and the aligned holes in the upper end of the downrod, thereby connecting the hollow sleeve to the downrod.

The ball may include a pair of diametrically opposed slots formed in the annular wall of the ball and extending longitudinally from the upper end of the ball toward the lower end of the ball. Each of these slots are effective for receiving one end of the pin thereby permitting the ball to translate somewhat in a longitudinal direction relative to the downrod. The hollow sleeve includes a slit which extends through the wall of the sleeve longitudinally from the lower end of the sleeve to and through the upper end of the sleeve thereby subdividing the sleeve into first and second circumferentially extending portions and permitting the sleeve to conform to the shape of the upper end of the ceiling fan downrod. The sleeve may further include a plurality of relief notches extending through the sleeve wall, with the notches extending longitudinally from one of the sleeve ends toward the other of the sleeve ends, with the notches facilitating circumferential compression of the sleeve for the purpose of conforming to the shape of the downrod. The sleeve may also include a generally U-shaped relief notch extending through the sleeve wall and longitudinally from the upper end of the sleeve toward the lower end of the sleeve. The ball may further include a third slot formed in the annular wall of the ball and extending from the upper end toward the lower end of the ball. The generally U-shaped relief notch of the sleeve is aligned with the third slot in the ball, whereby the U-shaped notch and third slot are effective for receiving a means for grounding the ceiling fan which is attached to the upper end of the ceiling fan downrod.

BRIEF DESCRIPTION OF THE DRAWINGS

These and other features, aspects, and advantages of the present invention will become better understood with regard to the following description, appended claims and accompanying drawings wherein:

DETAILED DESCRIPTION

Figure 1:
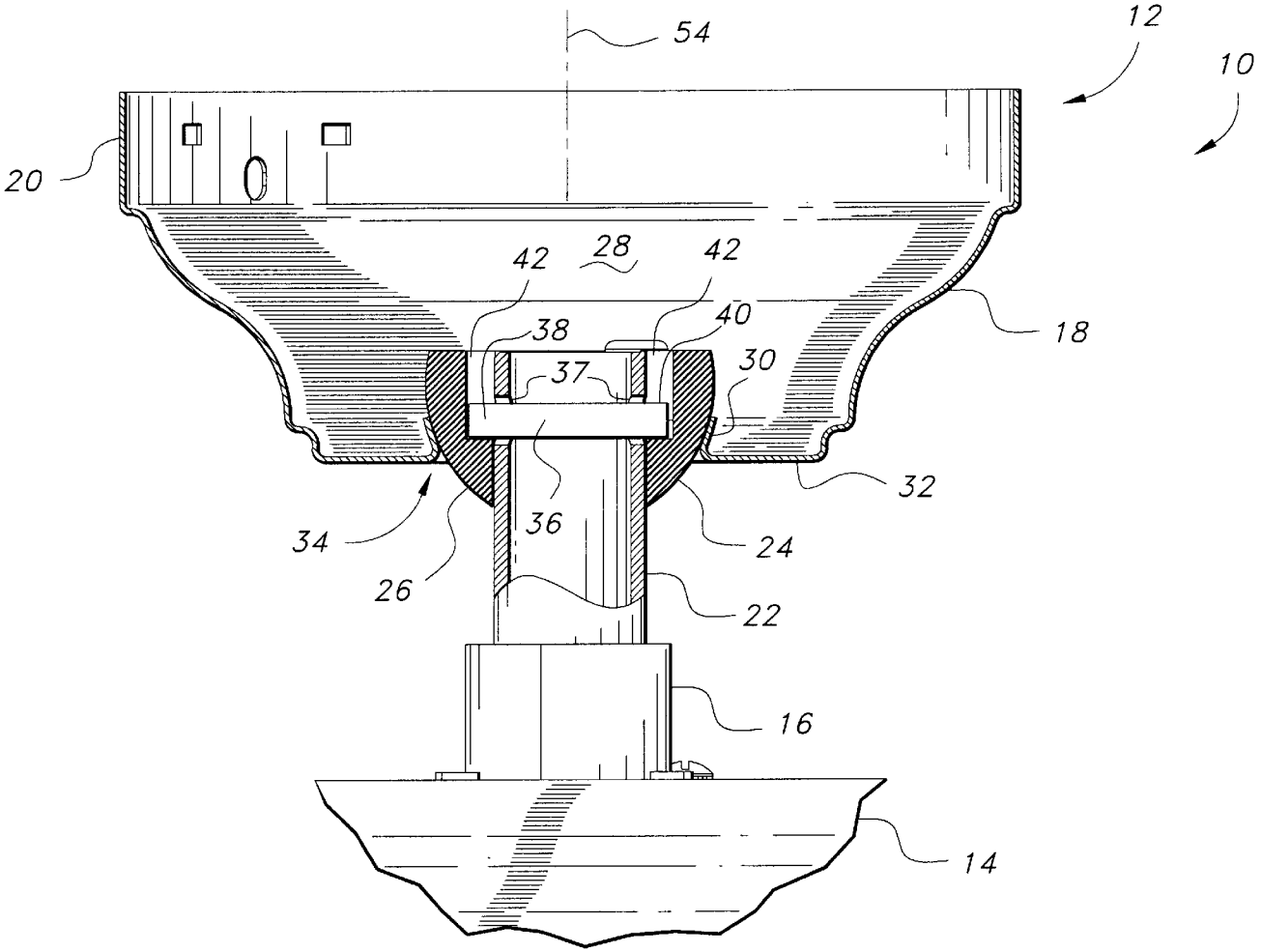
FIG. 1 is a fragmentary elevation view, partially in cross-section, illustrating a prior art ceiling fan suspension system.
Figure 2:
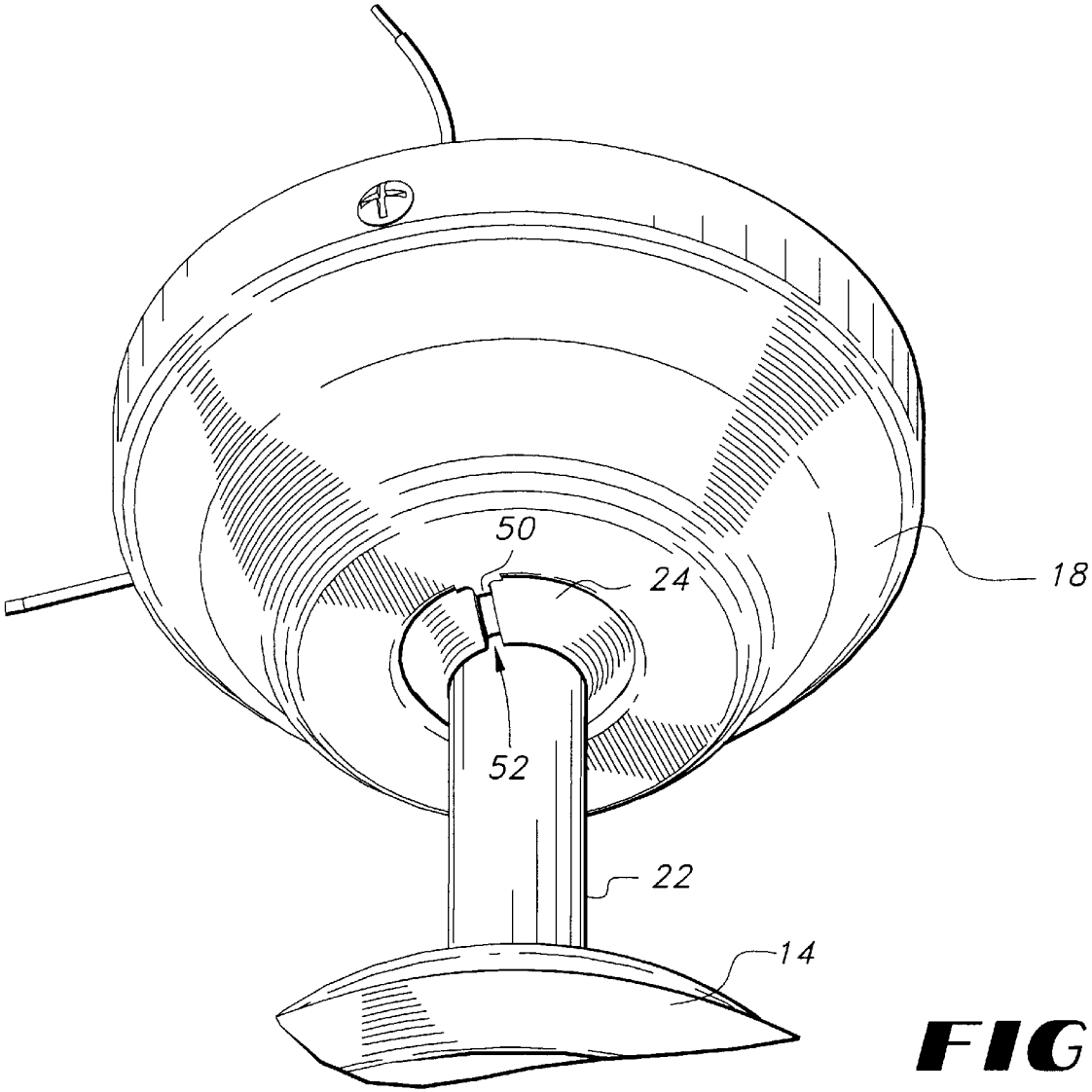
FIG. 2 is a perspective view further illustrating the prior art ceiling fan suspension system shown in FIG. 1.
Figure 3:
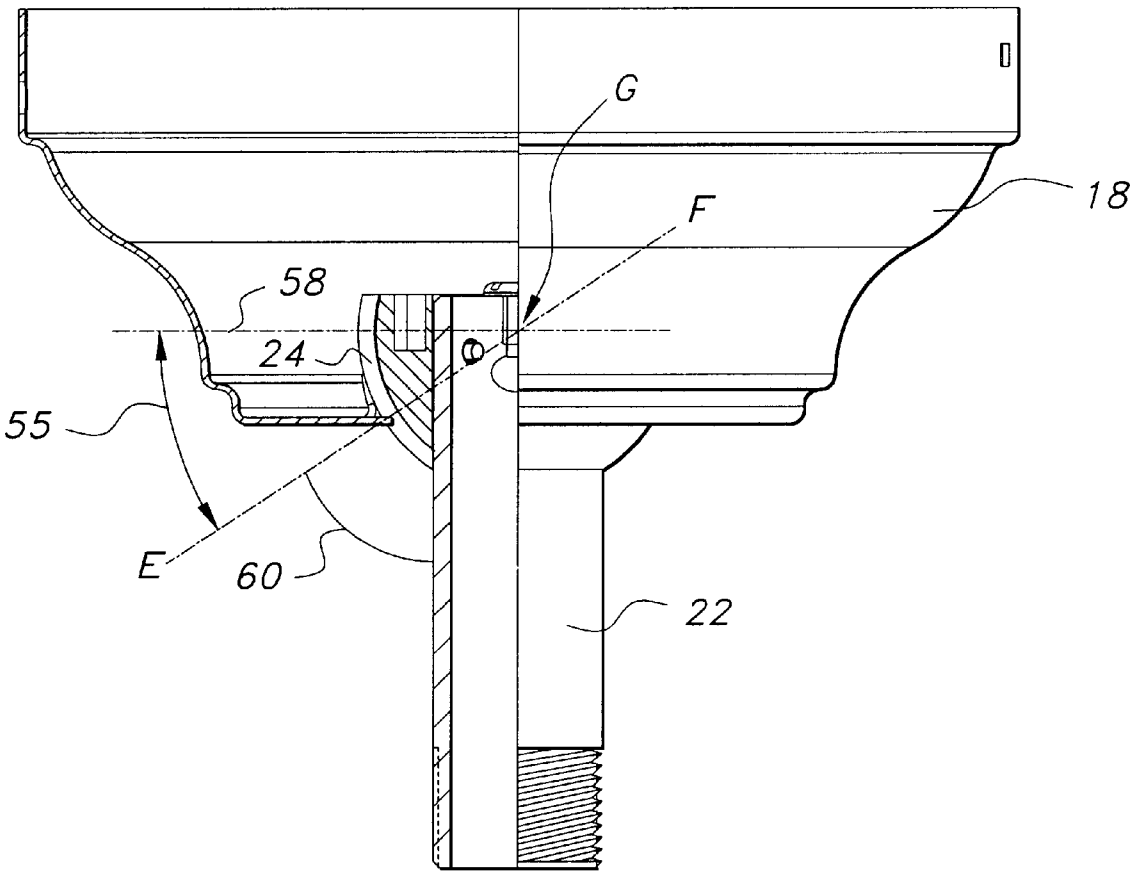
FIG. 3 is a fragmentary elevation view, partially in cross-section, similar to FIG. 1, further illustrating the prior art ceiling fan suspension system shown in FIG. 1.
Figure 4:
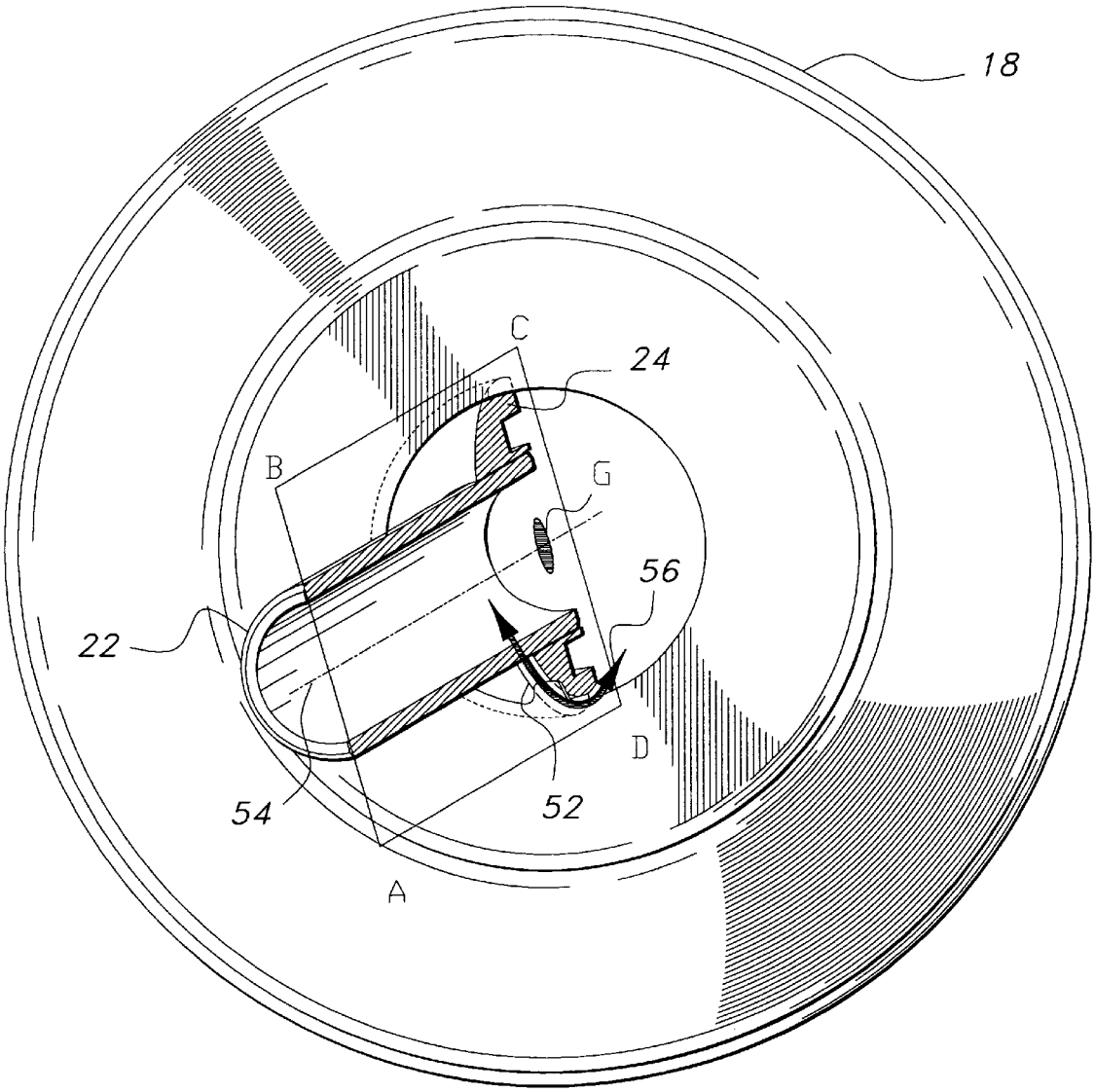
FIGS. 4–7 are a series of bottom plan views of the prior art suspension system shown in FIGS. 1–3, illustrating various positions of the included downrod and ball during operation of the ceiling fan.
Figure 5:
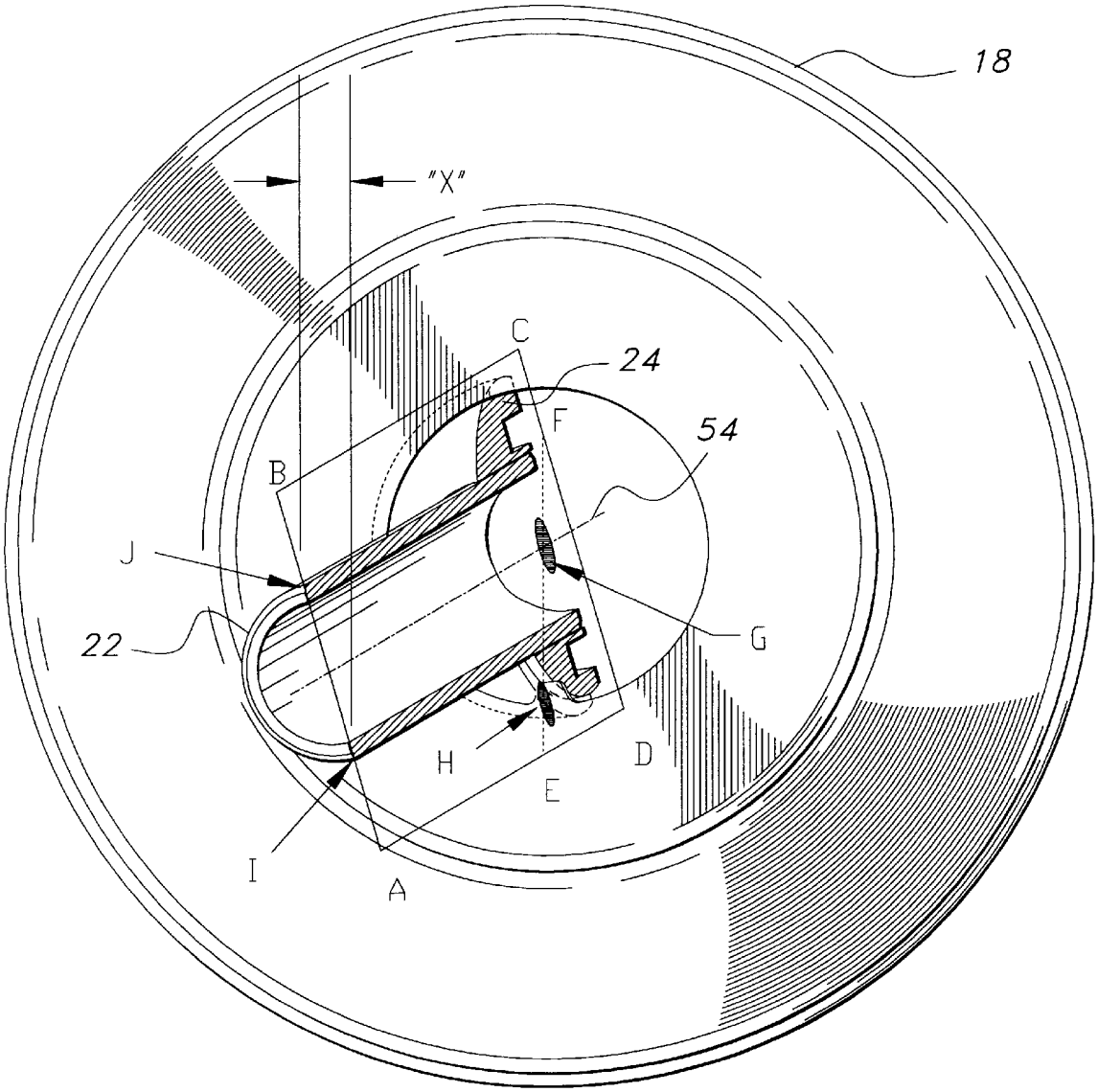
Figure 6:
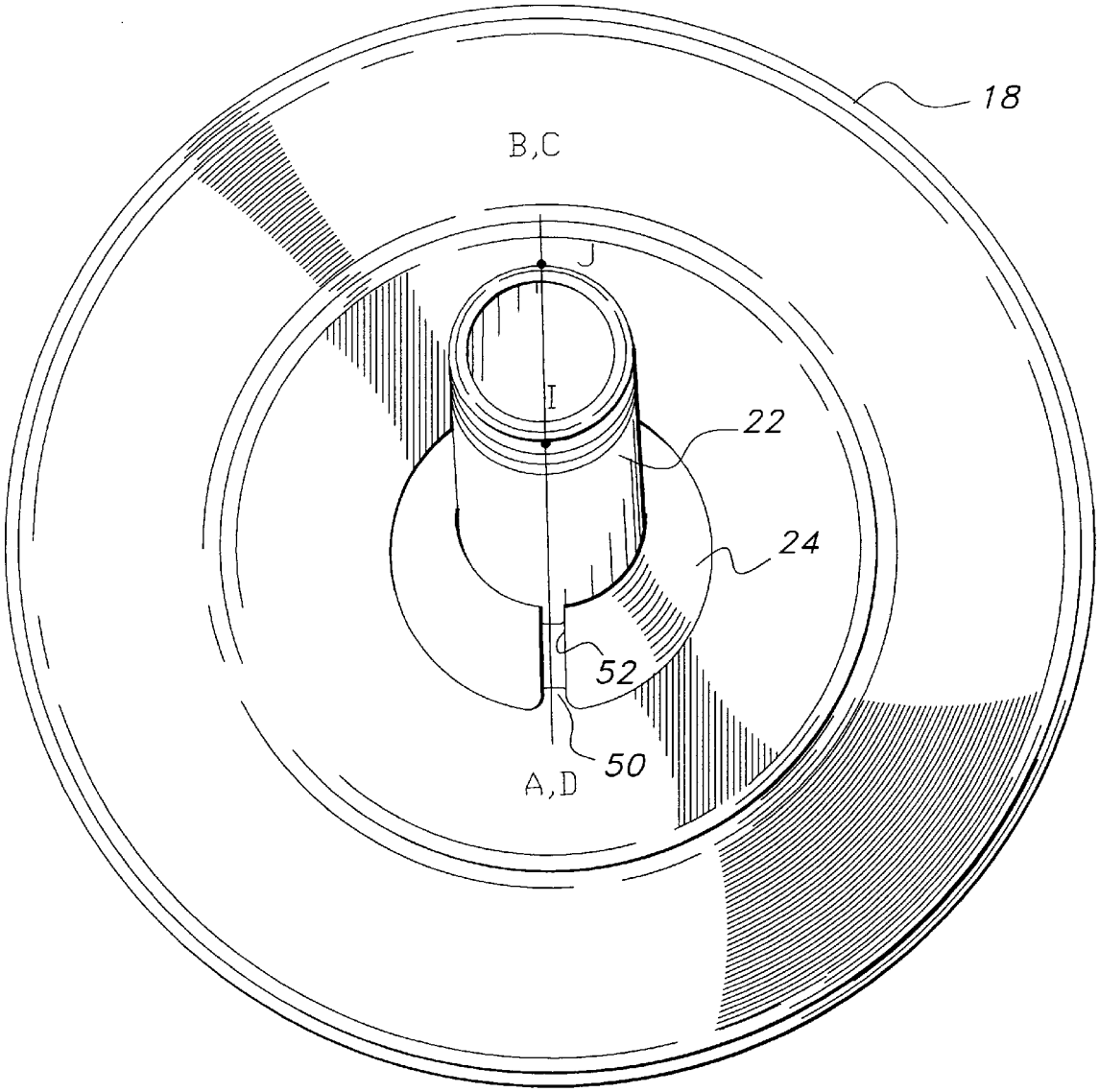
Figure 7:
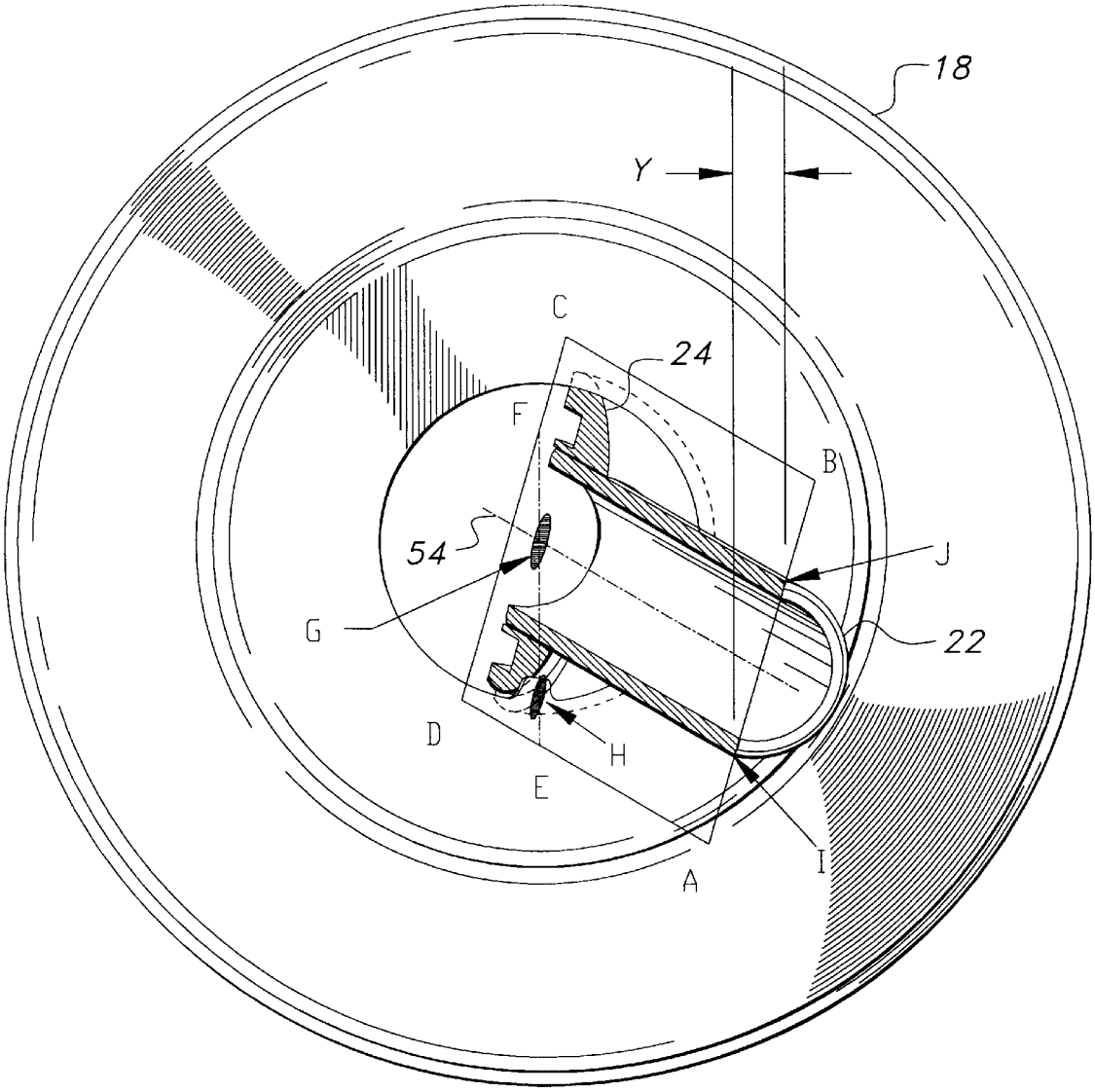
Figure 8:
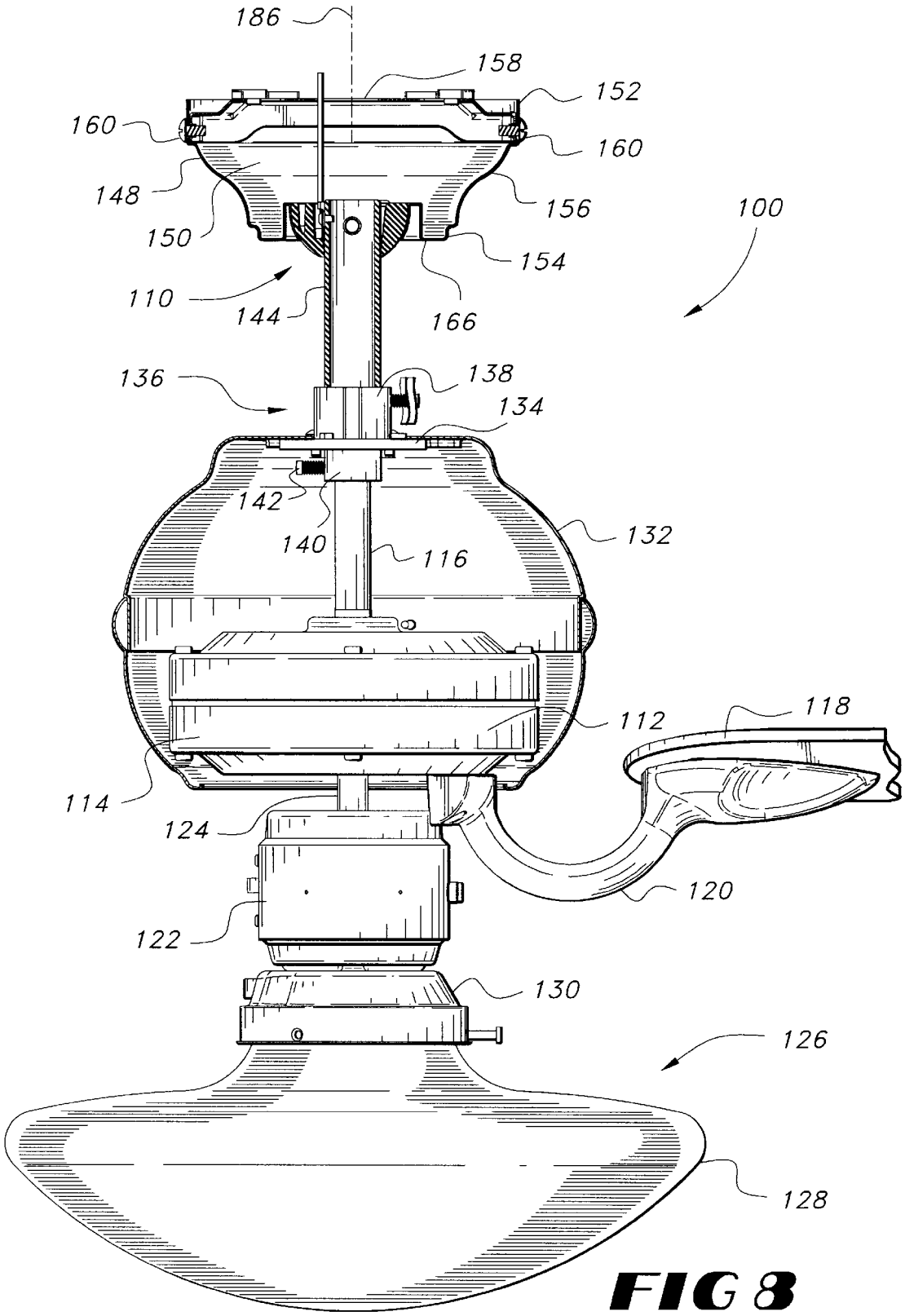
FIG. 8 is an elevation view, partially in cross-section and partially in cutaway view, of a ceiling fan which is suspended using the system of the present invention.

Referring now to the drawings, FIG. 8 is an elevation view, partially in cross-section and partially in cutaway view, illustrating a ceiling fan 100 which is suspended from a ceiling or other support structure (not shown) using a system, indicated generally at 110, according to the present invention. The ceiling fan 100 includes a motor 112 having a rotor 114 and a stator (partially obscured in FIG. 8) including a stator shaft 116. In the illustrative embodiment, the motor 112 comprises an inside-out motor wherein the rotor 114 is disposed in surrounding relationship with the stator. However, the particular configuration of the electric motor of the ceiling fan 100 does not form a part of the present invention, and the system 110 of the present invention may be utilized with ceiling fans having other types of motors, for instance those where the stator surrounds the rotor. Ceiling fan 100 further includes a plurality of fan blades 118 (one shown in fragmentary view) which are connected to the rotor 114 of motor 112 via blade irons 120 (one shown). Ceiling fan 100 further includes a switch housing 122 which is suspended below motor 112 via a lower end 124 of the stator shaft 116. In the illustrative embodiment, ceiling fan 100 includes a light fixture 126 having a globe 128 and a globe retaining socket 130 attached to a lower portion of the switch housing 122. The switch housing defines a hollow interior space in which the electrical circuitry required to operate the light fixture and the direction and speed of motor 112 is disposed.

Ceiling fan 100 also includes a motor housing 132 which is disposed in surrounding relationship with motor 112. The motor housing 132 may include a novel configuration or decorative outer surface. However, the particular configuration or design of motor housing 132 does not form a part of the present invention. The motor housing 132 is supported by a flange portion 134 of an adapter 136 having upper 138 and lower 140 receptacles. The lower receptacle 140 receives an upper end portion of the stator shaft 116 and is attached thereto. The upper end portion of the stator shaft 116 and receptacle 140 may be threaded to one another and the attachment may be further secured by a fastener 142. Ceiling fan 100 also includes a downrod 144 having a lower end which is disposed within and attached to the upper receptacle 138 of adapter 136. The downrod 144 has an upper end portion 146 which is connected to the system 110 for suspending a ceiling fan, as subsequently discussed in greater detail.

System 110 includes a hollow canopy 148 defining an interior space 150 and including an upper end portion 152, a lower end portion 154 and a central, body portion 156 extending between the upper 152 and lower 154 end portions. In the illustrative embodiment, the upper end portion 152 of canopy 148 comprises an annular flange which is operatively attachable to a support structure (not shown) such as a ceiling of a room or an electrical junction box disposed above the ceiling. In the illustrative embodiment, the upper end portion 152 of canopy 148 is attached to the support structure via a bracket 158 which is attached to the upper end portion 152 via fasteners 160 which pass through apertures 162 formed in the upper end portion 152. The bracket 158 is attached, preferably by fasteners, to the support structure. Bracket 158 may be configured as the bracket disclosed in co-pending and commonly assigned U.S. patent application Ser. No. 08/693,958, which is expressly incorporated by reference herein in its entirety. In this instance, the bracket 158 includes a pair of hooks protruding from one end of the bracket 158 which permits the canopy 148 to be pivotally suspended from the end of bracket 158 from which the hooks protrude. This facilitates supporting ceiling fan 100 while electrical connections are being made. However, it should be understood that any suitable bracketry or other attachment means may be used in lieu of bracket 158 to attach or connect the canopy 148 to the ceiling or other support structure. As shown in FIG. 8, the central body portion 156 of canopy 148 is generally bell shaped. However, it should be understood that the particular shape of the upper end portion 152 and central body portion 156 of canopy 148 may vary within the scope of the present invention.

Figure 10:
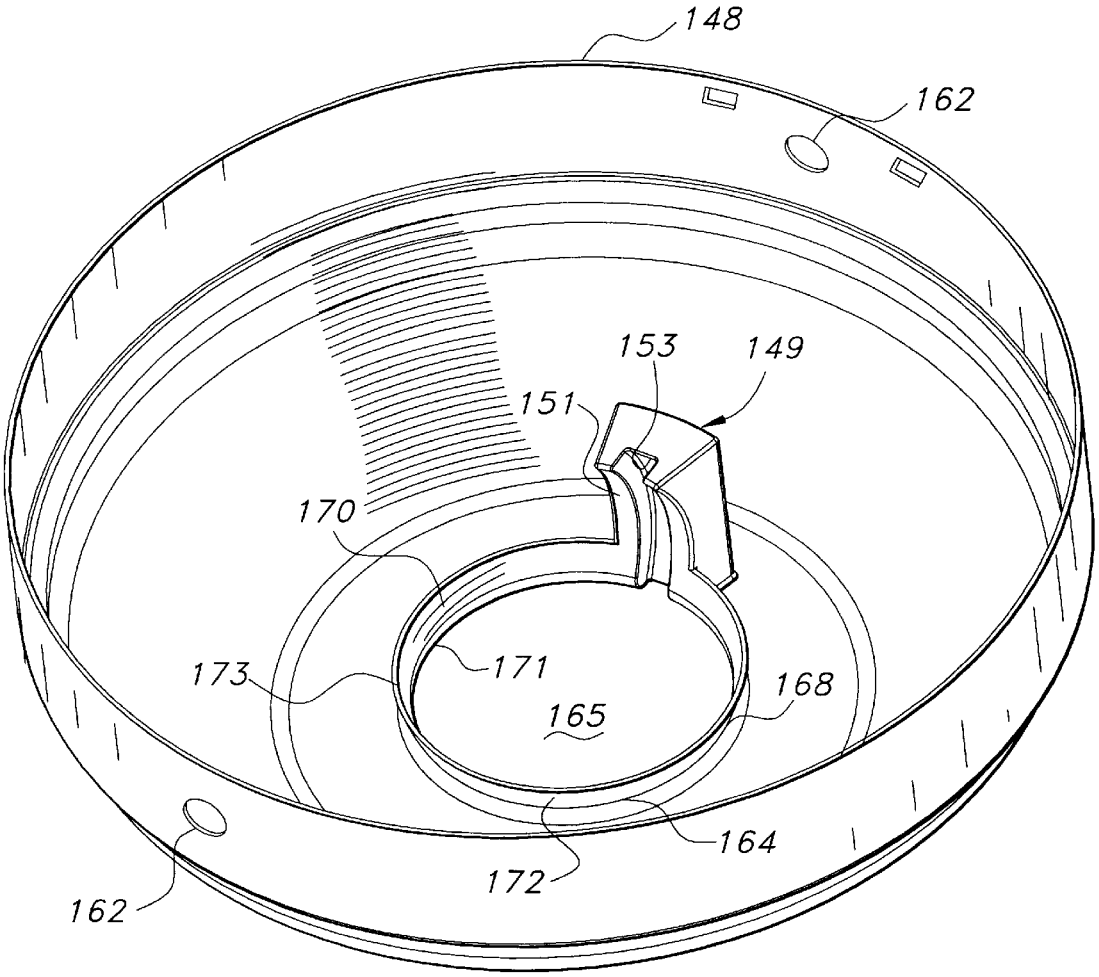
FIG. 10 is a perspective view further illustrating the canopy of the present invention which is shown in FIGS. 8–9.
Figure 11:
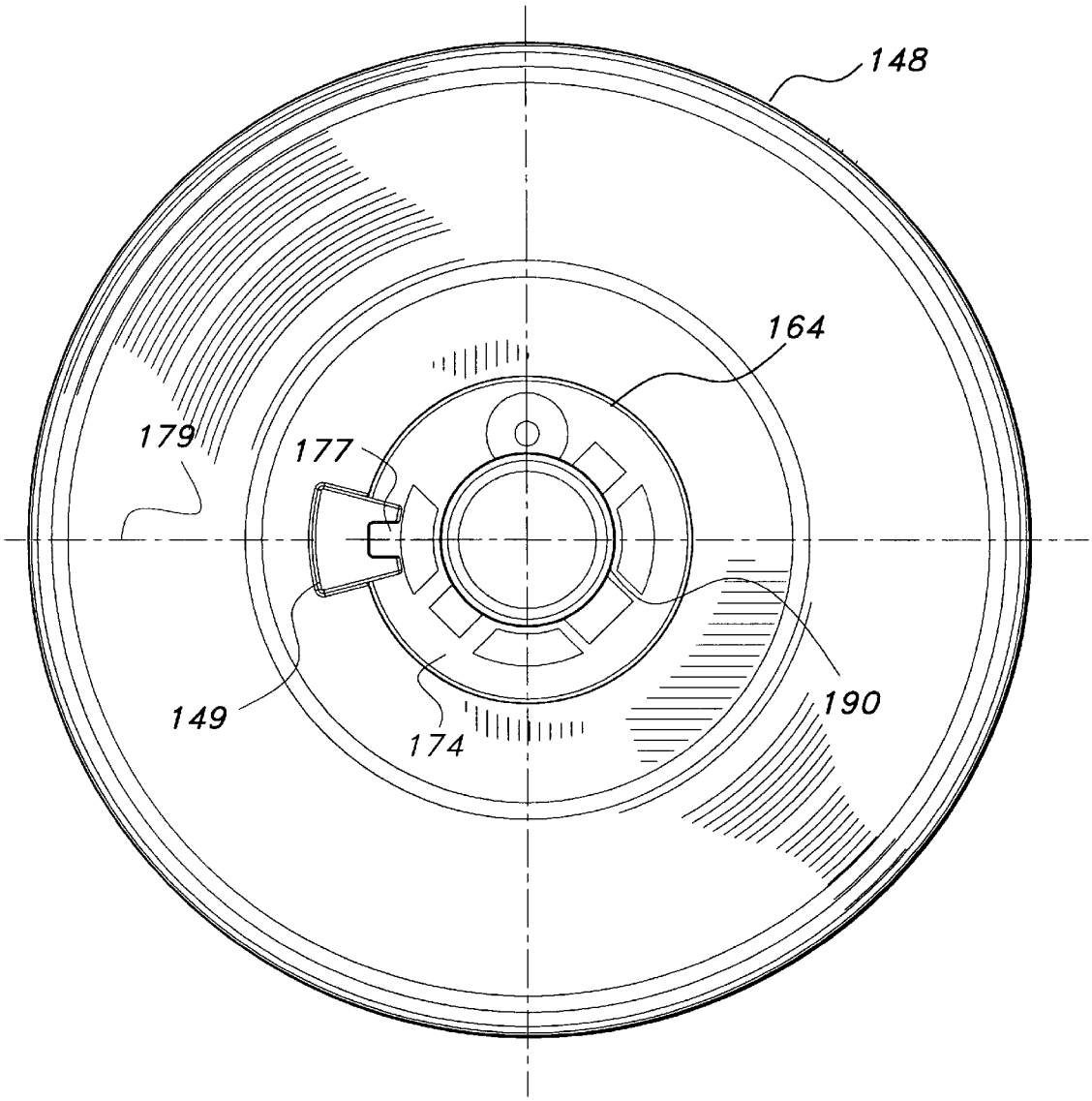
FIG. 11 is a top plan view of the canopy shown in FIG. 10.

As best seen in FIGS. 10 and 11, canopy 148 further includes a seat 164 which is connected to the lower end portion 154 and extends upwardly from a bottom surface 166 of the lower end portion 154. Seat 164 includes an outer surface 168 and an inner surface 170 defining an annular wall 172 therebetween. In the illustrative embodiment, the outer surface 168 of seat 164 has a substantially cylindrical shape. However, the shape of the outer surface 168 is relatively unimportant. In the illustrative embodiment, the inner surface 170 of seat 164 comprises a spherical surface. As shown in FIG. 10, seat 164 defines an aperture 165 which extends through seat 164 and through the bottom surface 166 of the lower end portion 154 canopy 148.

Canopy 148 further includes a guide 149 connected to and extending upwardly from the lower end portion 154 of canopy 148 within the interior space 150. The guide 149 has an inner surface 151 which forms a portion of the seat 164 of canopy 148. The guide 149 defines a receptacle 153 which extends through the seat 164. The receptacle 153 extends to the bottom surface 166 of the lower end portion 154 of canopy 148. Further, as shown in the embodiment illustrated in FIG. 10, the receptacle 153 may extend through the bottom surface 166 of the lower end portion 154 of canopy 148. In other embodiments, receptacle 153 may not extend through surface 166. As shown in FIG. 10, the guide 149 extends above seat 164, for subsequently described purposes. In the illustrative embodiment, the inner surface 151 of guide 149 has an accurate shape which, at its lower end, matches the remainder of seat 164. In other embodiments, the portion of the inner surface 151 which extends above seat 164 may have other shapes.

The upper end portion 152, lower end portion 154 and central body portion 156 of canopy 148 are preferably made from a metal or metallic alloy and may include a decorative outer surface finish. In one embodiment the seat 164 and guide 149 are integrally formed with portions 152, 154 and 156 of canopy 148 using conventional methods such as stamping or casting. In this embodiment seat 164 and guide 149 are made from the same metal or metallic alloy as the remainder of canopy 148. In other embodiments, seat 164 and guide 149 may be manufactured separately from the remainder of canopy 148 and then attached to the lower end portion 154 of canopy 148. For instance, seat 164 and guide 149 may be made from molded plastic such as ABS or cast metal such as zinc, with seat 164 and guide 149 then bonded or otherwise attached to the lower end portion 154 of canopy 148. Also, seat 164 and guide 149 may be made from other materials including nylon. In the foregoing embodiment, where seat 164 and guide 149 are manufactured separately from the remainder of canopy 148, seat 164 and guide 149 are preferably made as a one-piece construction.

Prior to attaching the upper end portion 152 of canopy 148 to the ceiling or other support structure, the system 110 is connected to the stationary portion of ceiling fan 100 as subsequently described. System 110 further includes a ball 174, having an upper end 176, a lower end 178, an outer surface 180 and an inner surface 182 which define an annular wall 184 extending between the upper 176 and lower 178 ends of the ball 174. In one preferred embodiment, ball 174 is made from a nylon material manufactured by Autochem, located in Serguigny, France. The nylon material has a manufacturer's designation of BMNY 1.47. Seat 164 and guide 149 of canopy 148 may also be made of this nylon material in the embodiments where seat 164 is manufactured separately from the remainder of the canopy as discussed previously. In other embodiments, ball 174 may be made from plastic materials, such as ABS, or may be made from various metals or metallic alloys such as steel. The outer surface 180 of ball 174 preferably has a textured surface but may also have a smooth surface. The textured surface is preferred since this may facilitate the pivoting action of ball 174 during operation of fan 100. In the illustrative embodiments the outer surface 180 of ball 174 is shown as being smooth.

The inner surface 182 of ball 174 has a frustoconical shape and tapers radially outwardly from the lower end 178 to the upper end 176 of ball 174, for subsequently described purposes. The outer surface 180 of the ball 174 has a shape which is complementary to the shape of the inner surface 170 of seat 164 of canopy 148, which comprises an important feature of the present invention. In the illustrative embodiment, the outer surface 180 of ball 174 comprises a spherical surface which is sized to fit within the inner surface 170 of canopy seat 164, which also comprises a spherical surface in the illustrative embodiment.

System 110 further includes a pin 177 which is attached to ball 174 and protrudes radially outwardly from the outer surface 180 of ball 174. Pin 177 and ball 174 are preferably made as a one-piece construction. In this instance, pin 177 and ball 174 are made of the same material, such as the material described previously with respect to ball 174. However, it is considered to be within the scope of the present invention to manufacture pin 177 separately from ball 174 and then attach pin 177 to ball 174 by conventional means. For instance, a radially inward end of pin 177 may include threads (not shown in the illustrative embodiment) which are threaded into a hole (not shown in the illustrative embodiment) having matching threads formed in the ball 174.

Figure 12:
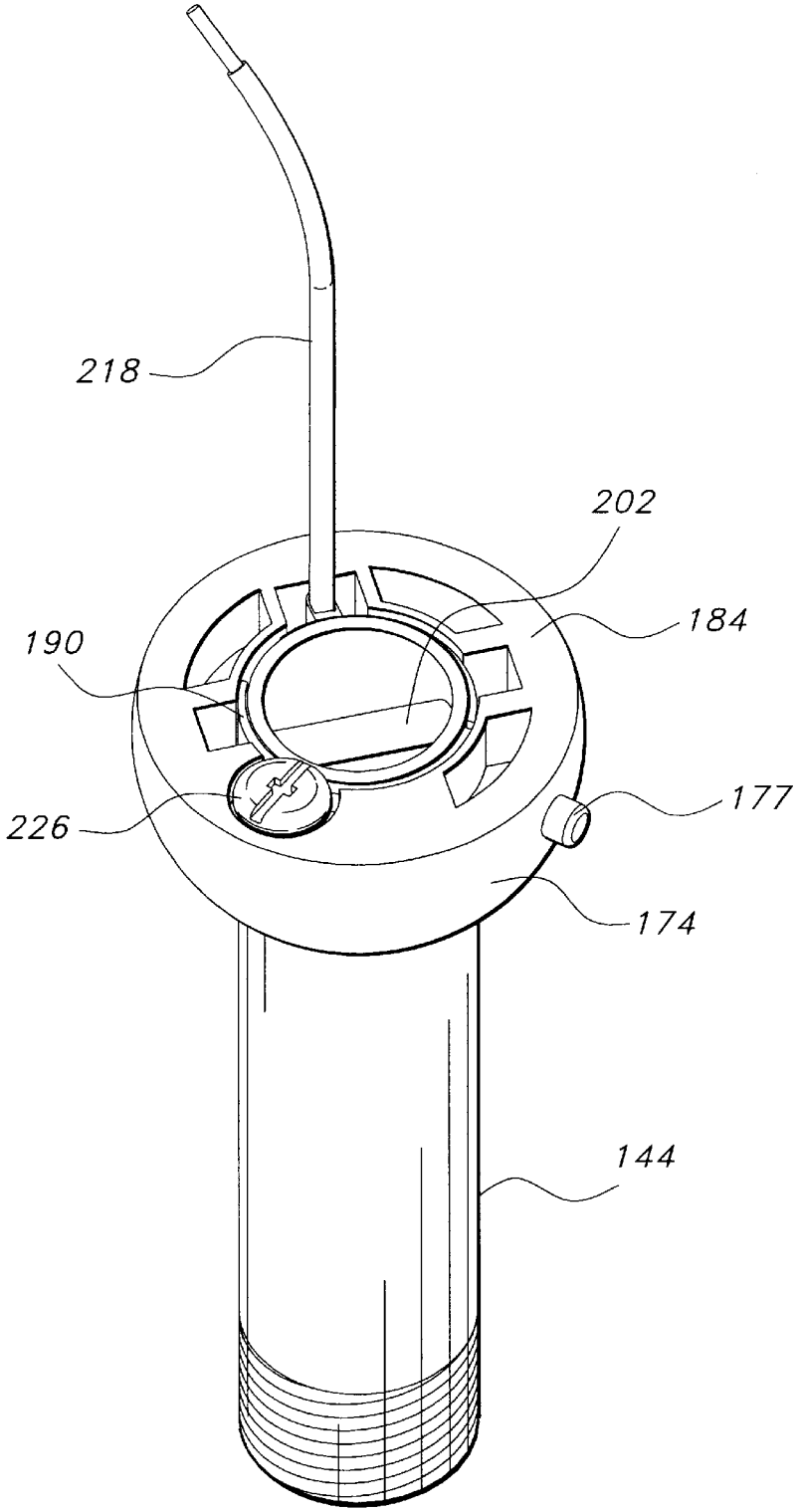
FIG. 12 is a perspective view of a downrod and ball assembly, incorporating a ball and pin according to the present invention.

When ball 174 is disposed within seat 164 of canopy 148, the pin 177 engages the receptacle 153 which is defined by the guide 149 of canopy 148. As shown in FIG. 12, pin 177 has a substantially cylindrical shape, in the illustrative embodiment. Also, as shown in FIG. 10, the receptacle 153 has a substantially rectangular cross-sectional shape. However, in other embodiments, the shape of pin 177 and receptacle 153 may be other than that shown, provided that pin 177 may be engaged within receptacle 153 defined by the guide 149 of canopy 148.

Figures 15, 16, 17:
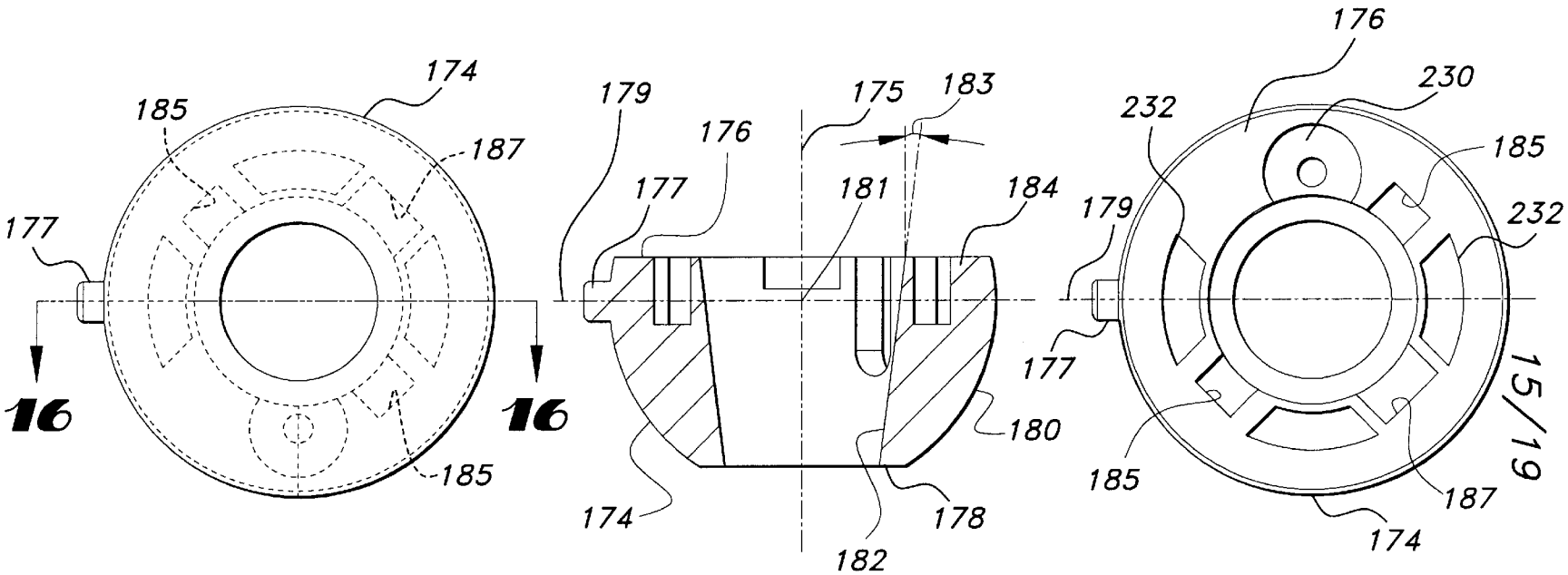
FIG. 15 is a bottom plan view of the ball shown in FIGS. 12–14.
FIG. 16 is a cross-sectional view taken along line 16—16 in FIG. 15.
FIG. 17 is a top plan view of the ball shown in FIGS. 12–16.
Figure 20:
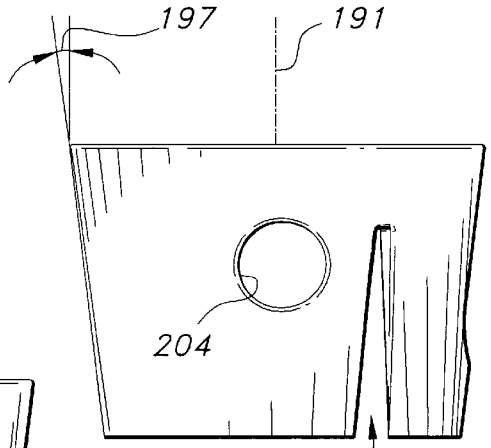
FIGS. 19–21 are elevation views further illustrating the sleeve shown in FIG. 18.
Figure 21:
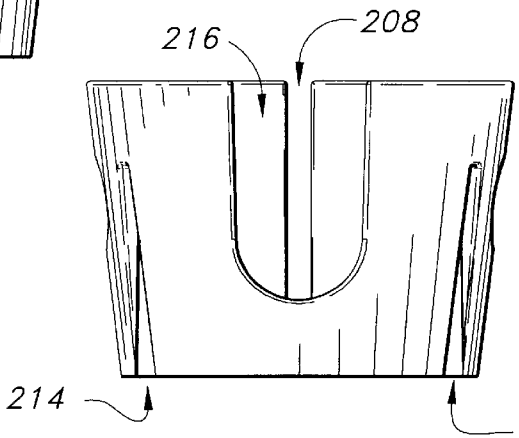
Figure 19:
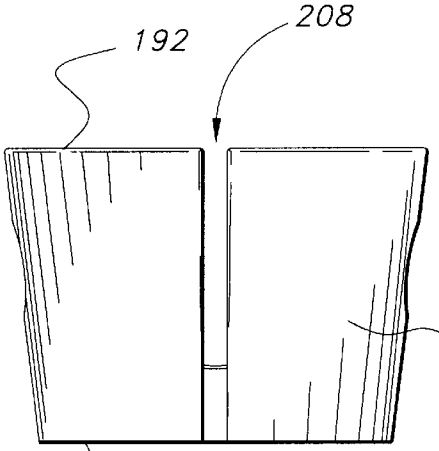
Figure 18:
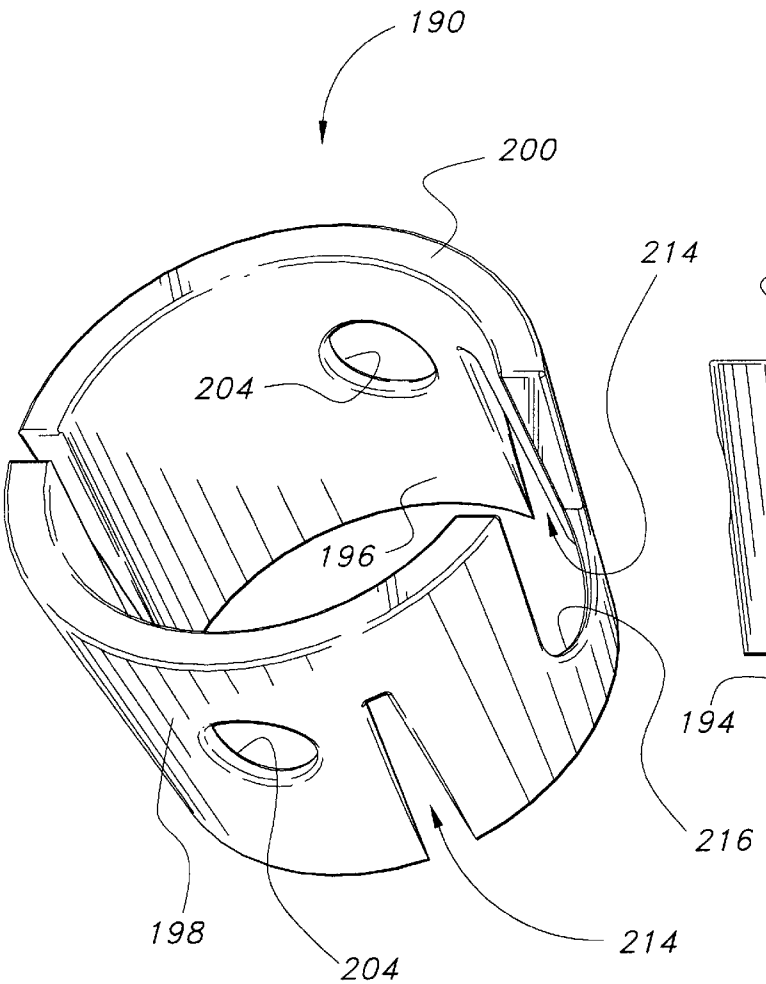
FIG. 18 is a perspective view of a sleeve according to the present invention, which is incorporated in the downrod and ball assembly shown in FIGS. 12–14.

As shown in FIG. 16, pin 177 includes a longitudinal centerline axis 179 which passes through ball 174 and intersects a center 181 of the spherical outer surface 180 of ball 174. The centerline axis 179 of pin 177 is substantially perpendicular to the longitudinal centerline axis 175 of ball 174. Accordingly, axis 179 is also substantially perpendicular to the longitudinal centerline axis 186 of ceiling fan 100 when ball 174 is disposed within seat 164 of canopy 148, since the centerline axis of ball 175 is coincident with the centerline axis 186 of ceiling fan 100 when ball 174 is positioned within seat 164. The fact that axis 179 is substantially perpendicular to both axis 175 and axis 186, comprises an important feature of the present invention. The spherical surfaces 180 of ball 174 and 170 of seat 164 of canopy 148 interact with one another to allow ball 174 and the ceiling fan 100 to pivot about the longitudinal centerline axis 179 of pin 177. Pin 177 and receptacle 153 of guide 149 cooperate with one another to prevent the ball 174 and the ceiling fan 100 from rotating about the longitudinal centerline axis 186 of ceiling fan 100, thereby preventing the electrical wires (not shown) which control the operation of the ceiling fan from becoming entangled during operation of the ceiling fan 100. These wires are routed upward through the hollow interior of downrod 144 and the interior space 150 defined by canopy 148, to the electrical junction box (not shown). The pin 177, and accordingly the centerline axis 179 of pin 177, move with ball 174 as the ball 174 pivots within the canopy seat 164. This comprises an important feature of the present invention. The fact that axis 179 moves with ball 174 results in axis 179 remaining substantially perpendicular to the longitudinal centerline axis 186 of ceiling fan 100, regardless of the position of ball 174 within seat 164 of canopy 148. As a result, axis 186 of ceiling fan 100 remains substantially vertically disposed during operation of the ceiling fan 100, unlike ceiling fans which are suspended by conventional systems such as that described in conjunction with FIGS. 1–7.

Referring now to FIGS. 12–14 and 18–21, system 110 further includes a hollow sleeve 190 having open upper 192 and lower 194 ends. In one preferred embodiment sleeve 190 may be made from the same nylon material as that described previously with respect to ball 174. However, sleeve 190 may also be constructed from other materials including various plastics such as ABS and various metals or metallic alloys such as steel. The hollow sleeve 190 includes inner 196 and outer 198 surfaces forming a wall 200 extending therebetween. The hollow sleeve 190 is disposed in surrounding relationship with the upper end portion 146 of the downrod 144, and is connected to the upper end portion 146 via a pin 202 shown in FIGS. 12–14. Sleeve 190 includes a pair of diametrically opposed apertures 204, comprising substantially circular holes in the illustrative embodiment, which extend radially through the wall 200 of sleeve 190. The upper end portion 146 of the downrod 144 also includes a pair of diametrically opposed apertures 206, comprising substantially circular holes in the illustrative embodiment, extending radially therethrough. Sleeve 190 is positioned in surrounding relationship with the upper end portion 146 of the downrod 144 so that apertures 204 of sleeve 190 are aligned with apertures 206 in the upper end portion 146 of downrod 144. Pin 202 is then inserted through the apertures 204 and the aligned apertures 206, thereby connecting the hollow sleeve 190 to the upper end portion 146 of the downrod 144.

The inner surface 196 of sleeve 190 is substantially cylindrically shaped to conform to the shape of the upper end portion 146 of the downrod 144. The fit of sleeve 190 to the upper end portion 146 of downrod 144 is further facilitated by the following features of hollow sleeve 190. Sleeve 190 includes a slit 208 which extends through the wall 200 and extends longitudinally from the lower end 194 to the upper end 192 of sleeve 190. This permits the sleeve 190 to contract and expand in a hoop or circumferential direction so as to conform to the upper end portion 146 of the downrod 144.

Sleeve 190 also includes a plurality of relief notches 214 which extend through the wall 200 and throughout a longitudinal portion of the sleeve 190. In the illustrative embodiment, the notches 214 extend upward from the lower end 194 toward the upper end 192 of sleeve 190. Alternatively, notches 214 may extend from the upper end 192 toward the lower end 194 of sleeve 190. The relief notches 214 further facilitate expansion or compression of sleeve 190 in a hoop or circumferential direction, thereby further facilitating the fit of sleeve 190 to the upper end portion 146 of downrod 144.

Figure 14:
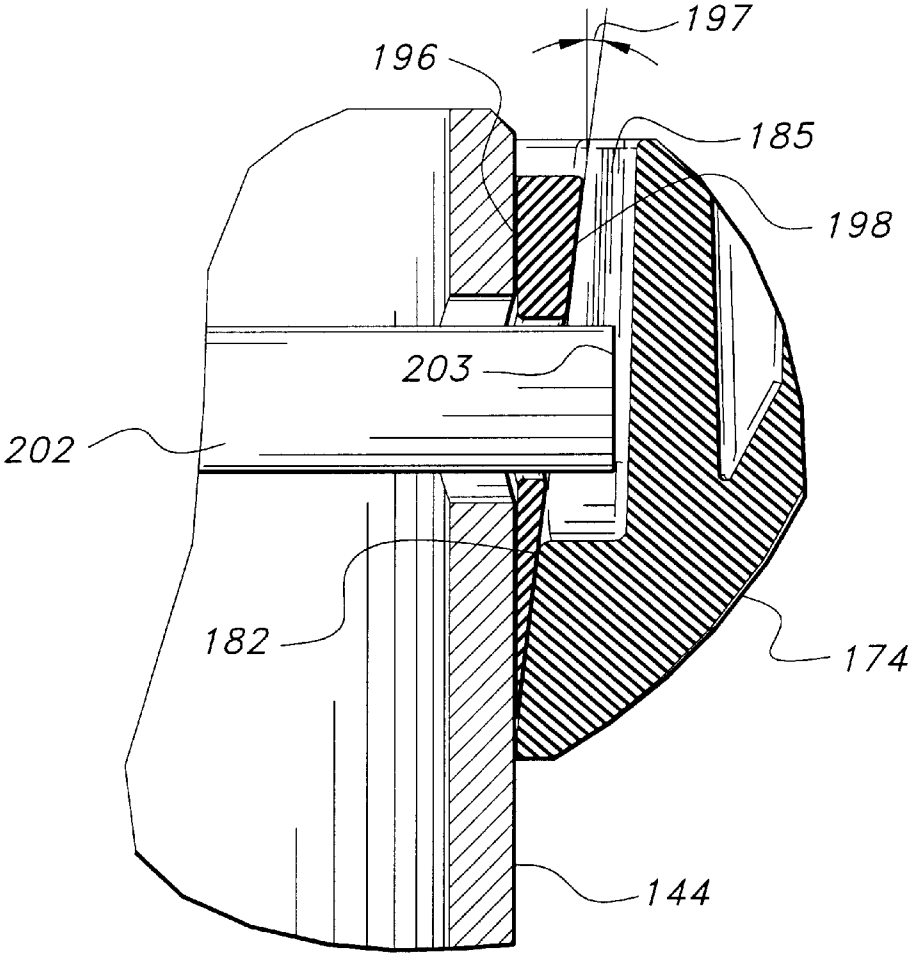
FIG. 14 is a fragmentary cross-sectional view further illustrating the downrod and ball assembly shown in FIGS. 12 and 13.

The ball 174 is disposed in surrounding relationship with the hollow sleeve 190, as best seen in FIGS. 12 and 14, with the inner surface 182 of the ball 174 and the outer surface 198 of sleeve 190 being configured so that the ball 174 frictionally engages sleeve 190. More particularly, both the outer surface 198 of sleeve 190 and the inner surface 182 of the ball 174 are tapered radially outwardly between the lower 194 and upper 192 ends of sleeve 190 and the lower 178 and upper 176 ends of the ball 174, respectively. The inner surface 182 of ball 174 has a radially outward taper 183, preferably ranging from about 1.0 degrees to about 15.0 degrees relative to a longitudinal centerline axis 175 of the ball 174. Most preferably, the taper 183 of the inner surface 182 of the ball 174 is about 7.0 degrees. Similarly, the outer surface 198 of sleeve 190 includes a radially outward taper 197 (shown in FIG. 14), which preferably ranges from about 1.0 degrees to about 15.0 degrees relative to a longitudinal centerline axis 191 of sleeve 190. Most preferably, the taper 197 of the outer surface 198 of sleeve 190 is about 7.0 degrees. The matching tapers 183 of ball 174 and 197 of sleeve 190, allow the ball 174 and sleeve 190 to frictionally engage one another. The tightness of the fit between ball 174 and sleeve 190 varies with the relative longitudinal position of ball 174 and sleeve 190.

Pin 202, which connects sleeve 190 to the upper end portion 146 of downrod 144, includes a pair of opposing ends 203. As shown in FIG. 14 with regard to one of the ends 203, each of the ends 203 of pin 202 is disposed within a longitudinally extending slot 185 formed in the annular wall 184 of ball 174 and opening onto the inner surface 182 of ball 174. Slots 185 extend longitudinally from the upper end 176 toward the lower end of 178 of the ball 174 and permits the ball 174 to move longitudinally upward or downward relative to pin 202 and sleeve 190. In the installed position, when ball 174 engages the seat 164 of canopy 148, the gravitational loads of ceiling fan 100 force the downrod 144 and sleeve 190 to move downward somewhat relative to the ball 174. As this occurs, the fit between ball 174 and sleeve 190 becomes increasingly tighter due to the interaction of the tapers 183 and 197 of ball 174 and sleeve 190, respectively. As seen in FIG. 14, the wall 200 of sleeve 190 has a wedge shaped cross-section which increases in size from the lower 194 to the upper 192 ends of sleeve 190.

The use of sleeve 190 to connect ball 174 to the upper end portion 146 of the downrod 144, in lieu of a set screw such as that described previously with respect to the conventional system for suspending a ceiling fan illustrated in FIGS. 1–7, results in a tight fit among the ball 174, sleeve 190 and the upper end portion 146 and a concentric positioning of the upper end portion 146 and sleeve 190 within ball 174. This results in reduced ceiling fan wobble relative to the use of the set screw of the aforementioned conventional suspension system. Accordingly, it may be appreciated that the hollow sleeve 190 may be advantageously used with other suspension systems such as the conventional system illustrated in FIGS. 1–7. In this instance, the inner surface of the conventional ball 24 would be modified to have a taper matching the taper 197 of the outer surface 198 of the hollow sleeve 190.

Figure 13:
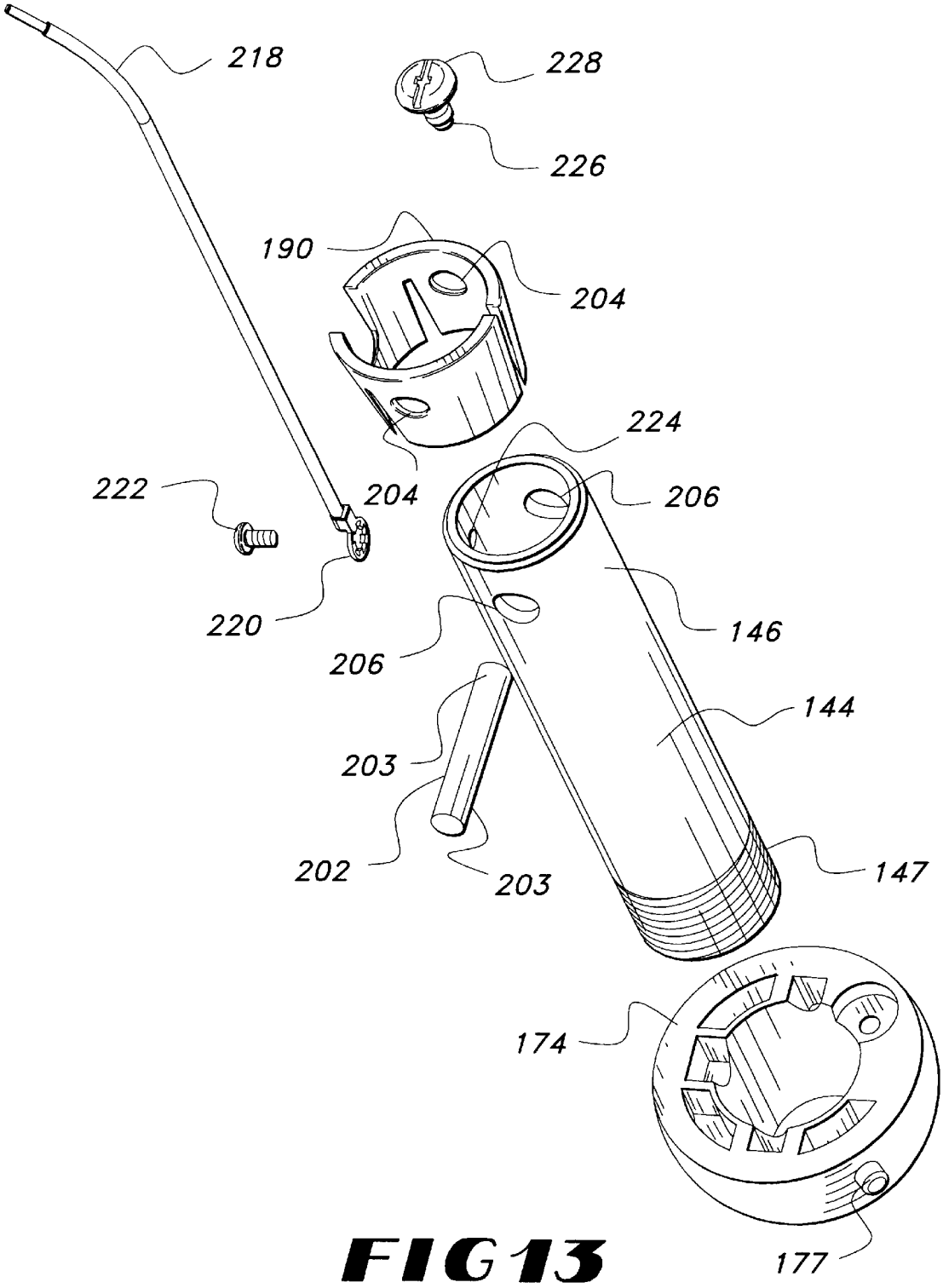
FIG. 13 is an exploded assembly of the downrod and ball assembly illustrated in FIG. 9.

The ball 174 further includes a slot 187 formed in the annular wall 184 and extending longitudinally from the upper end 176 toward the lower end 178 of ball 174. Slot 187 opens onto the inner surface 182 of ball 174. When ball 174 is disposed in surrounding relationship with sleeve 190, slot 187 is aligned with a generally U-shaped relief notch 216 formed in the wall 200 of sleeve 190 and extending from the upper end 192 toward the lower end 194 of sleeve 190. The slot 187 of ball 174 and the U-shaped notch 216 of sleeve 190 are effective for receiving a means for grounding the ceiling fan which comprises a ground wire 218 having a connector 220 attached at one end thereof. The connector 220 is attached to the upper end portion 146 of the downrod 144 via a conventional fastener 222, such as a screw of bolt, which passes through an opening in the connector 220 and is threaded into an opening 224 formed in the upper end portion 146 of downrod 144, as shown in FIG. 13. The connector 220 resides in the cavity formed by notch 187 of ball 174 and slot 216 of sleeve 190, with the wire 218 being routed outward through this cavity.

After the ball 174 has been disposed in surrounding relationship with sleeve 190, a fastener 226, comprising a screw or bolt, is threaded into the upper end 176 of the ball 174. The fastener 226 includes a head 228 which resides in a recess 230 formed in the upper end 176 of ball 174. The head 228 of fastener 226 is sized so that it overlaps, in a radial direction, the upper end 192 of the hollow sleeve 190. This prevents the hollow sleeve 190 from passing outward through the opening formed in the upper end 176 of the ball 174. The ball 174 may optionally include a plurality of recesses such as recesses 232, which may comprise various shapes, formed in the annular wall 184 of ball 174, at the upper end 176 of ball 174, for weight and cost reduction purposes.

Figure 22:
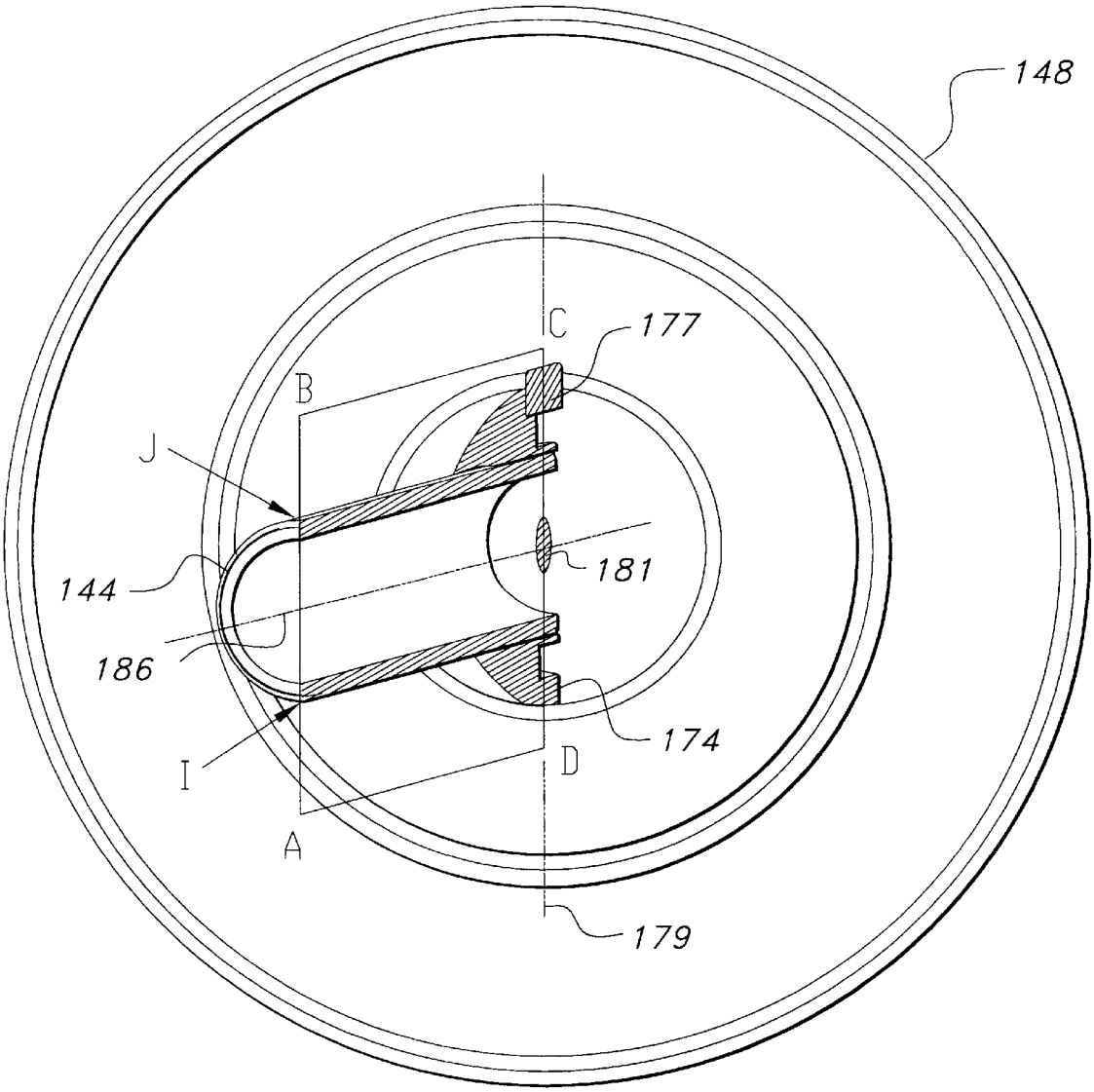
FIGS. 22–24 are a series of bottom plan views of the system according to the present invention shown in FIG. 8, illustrating various possible positions of the ball included in the system and the ceiling fan downrod attached to the ball.
Figure 23:
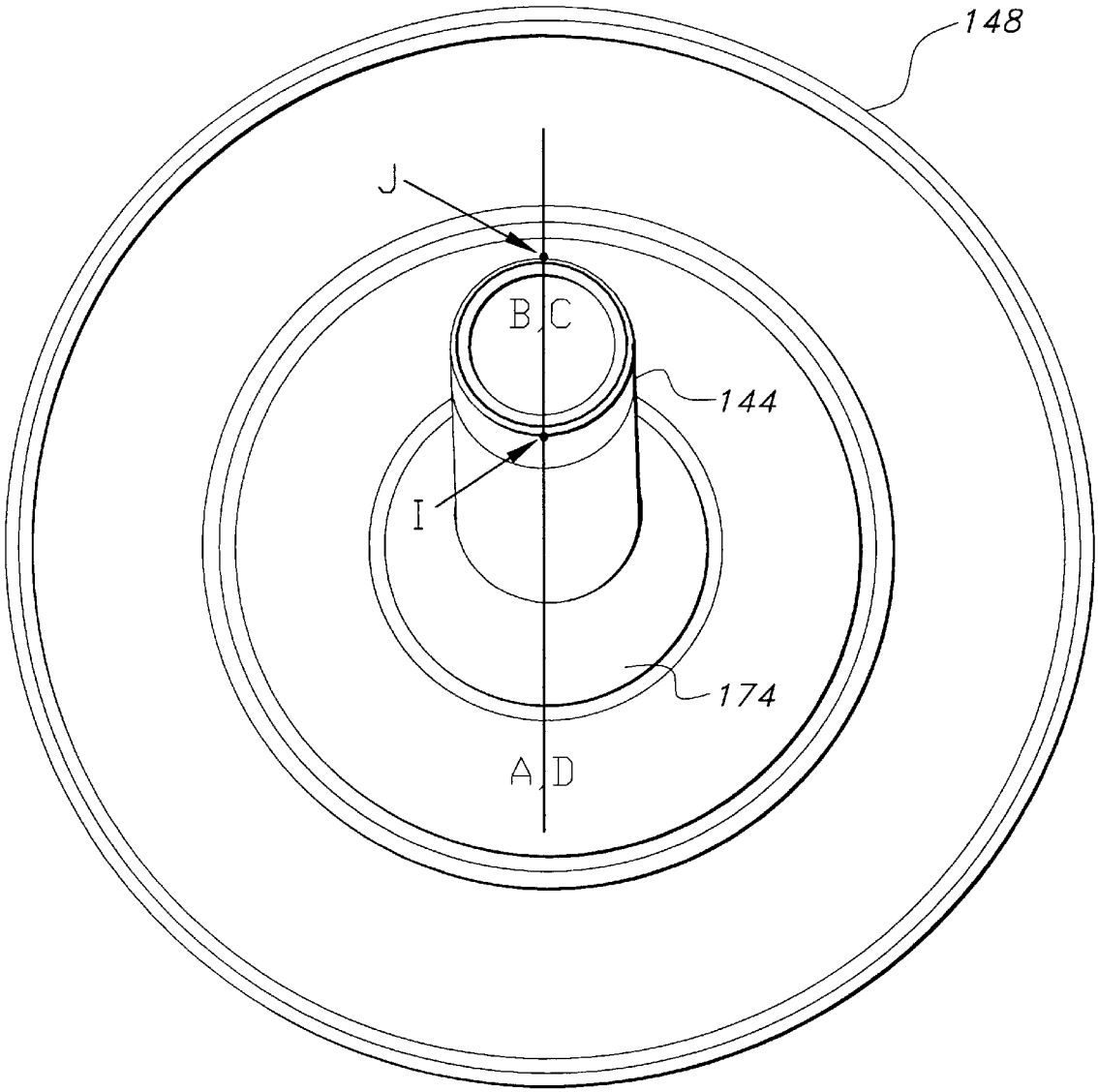
Figure 24:
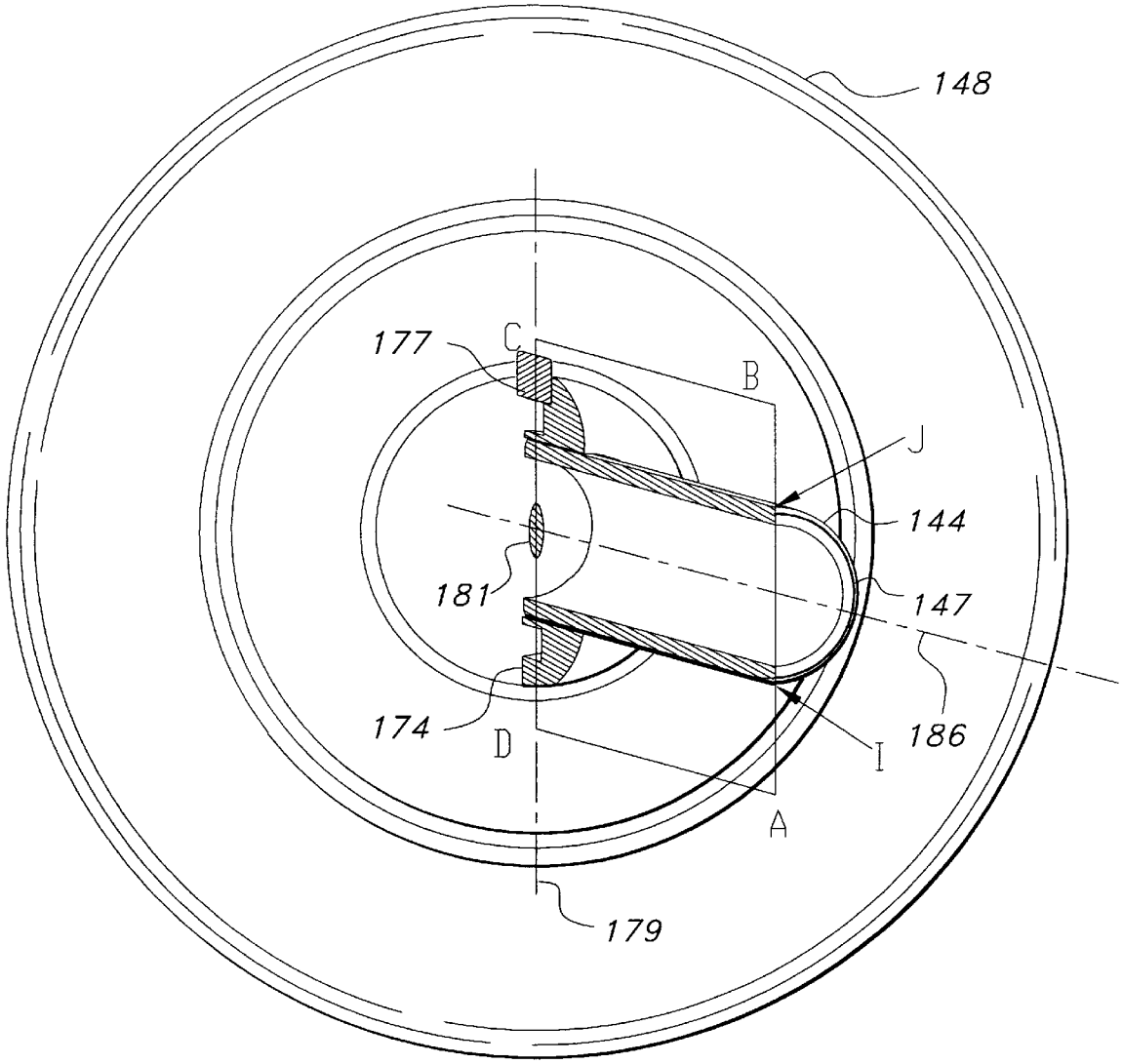

Once the sleeve 190 and ball 174 are assembled to the downrod 144, as shown in FIG. 12, the subassembly is inserted in the canopy 148 so that a lower threaded end 147 of the downrod 144 passes through the aperture 165 formed by the seat 164 of canopy 148, and extends below the canopy 148. The lower threaded end 147 of the downrod 144 is then threaded into the upper receptacle 138 of adapter 136, thereby joining the downrod 144 with the remaining portion of the ceiling fan 100. Ceiling fan 100 is then raised so that the canopy 148 is pivotally suspended from bracket 158, as discussed previously. The electrical wires necessary to operate ceiling fan 100 are routed upward through the hollow interior of the downrod 144 and are connected to the electrical junction box (not shown). The canopy is then secured to the bracket 158, completing the mounting of the ceiling fan 100 to the ceiling. In this installed position, the ball 174 is pivotally disposed within the seat 164 of the canopy 148. FIGS. 22–24 are bottom plan views illustrating the ball 174 disposed within canopy 148, with the downrod 144 protruding below the canopy 148.

As discussed previously, the shape of the spherical inner surface 170 of the seat 164 of canopy 148 complements the shape of the spherical outer surface 180 of ball 174. This is important since the complementary shapes of surfaces 170 and 180 permit the ball 174 to pivot within seat 164. Furthermore, the spherical outer surface 180 of ball 174 is sized such that the ball 174 protrudes through the aperture 165 formed by seat 164 and below the bottom surface 166 of canopy 148, as shown in FIG. 8. This is necessary to permit the ball 174 to pivot within seat 164 for a predetermined amount without the downrod 144 contacting canopy 148. This amount may vary with application, and the present invention is not limited by the particular distance that ball 174 protrudes below the bottom surface 166 of the lower end portion 154 of canopy 148. However, in one embodiment the ball 174 may protrude below the bottom surface 166 of canopy 148 by an amount to permit ball 174 to pivot sufficiently to accommodate a 34-degree slope of the ceiling to which canopy 148 is mounted. Since the ball 174 protrudes through the aperture 165, below seat 164, the size of the spherical outer surface 180 of ball 174, at a first predetermined longitudinal distance above the lower end 178 of ball 174, substantially matches the size of the spherical inner surface 170 of the seat 164, at a lower end 171 of seat 164. In one embodiment, the upper end 176 of the ball 174 extends above an upper end 173 of seat 164. In this instance, the size of the spherical inner surface 170 of canopy seat 164, at the upper end 173 of seat 164, substantially matches the size of the spherical outer surface 180 of ball 174 at a second predetermined longitudinal distance above the lower end 178 of ball 174. The particular height of canopy seat 164, as well as the corresponding magnitudes of the first and second predetermined longitudinal distances from the lower end 178 of ball 174 may vary with application.

In operation, ball 174 is pivotally disposed within the seat 164 of canopy 148. The spherical outer surface 180 of ball 174 and the spherical inner surface 170 of seat 164 interact with one another to allow the ball 174 and the ceiling fan 100 to pivot about the longitudinal centerline axis 179 of pin 177, which passes through the center 181 of the spherical outer surface 180 of ball 174 and is substantially perpendicular to the longitudinal centerline axis 186 of the ceiling fan 100. The engagement of pin 177 within the receptacle 153 of guide 149 of canopy 148 prevents the ceiling fan 100 from rotating about the longitudinal centerline axis 186 of ceiling fan 100. Reaction of the torque of motor 112 does not result in the ceiling fan 100 being canted at an angle relative to vertical during operation of ceiling fan 100, unlike ceiling fans incorporating the conventional suspension system illustrated in FIGS. 1–7. Instead, with the present invention, the centerline axis 186 of fan 100 remains substantially vertically disposed during operation of the ceiling fan 100. This is true because the ball 174 pivots within the canopy seat 164 about the longitudinal centerline axis 179 of pin 177 which is substantially perpendicular to the centerline axis 175 of the ball 174 and the centerline axis 186 of the ceiling fan 100 which are coincident when the ball 174 is installed. The pivot axis 179 moves with the ball 174 so that axis 179 remains substantially perpendicular to axis 186 regardless of the operational position of ball 174 within seat 164, unlike pivot axis EF of the conventional suspension system illustrated in FIGS. 1–7. The foregoing features of the present invention are further illustrated in FIGS. 22–24, which are bottom plan views illustrating the ball 174 and canopy 148 of the present invention, as well as the downrod 144 of ceiling fan 100.

Figure 9:
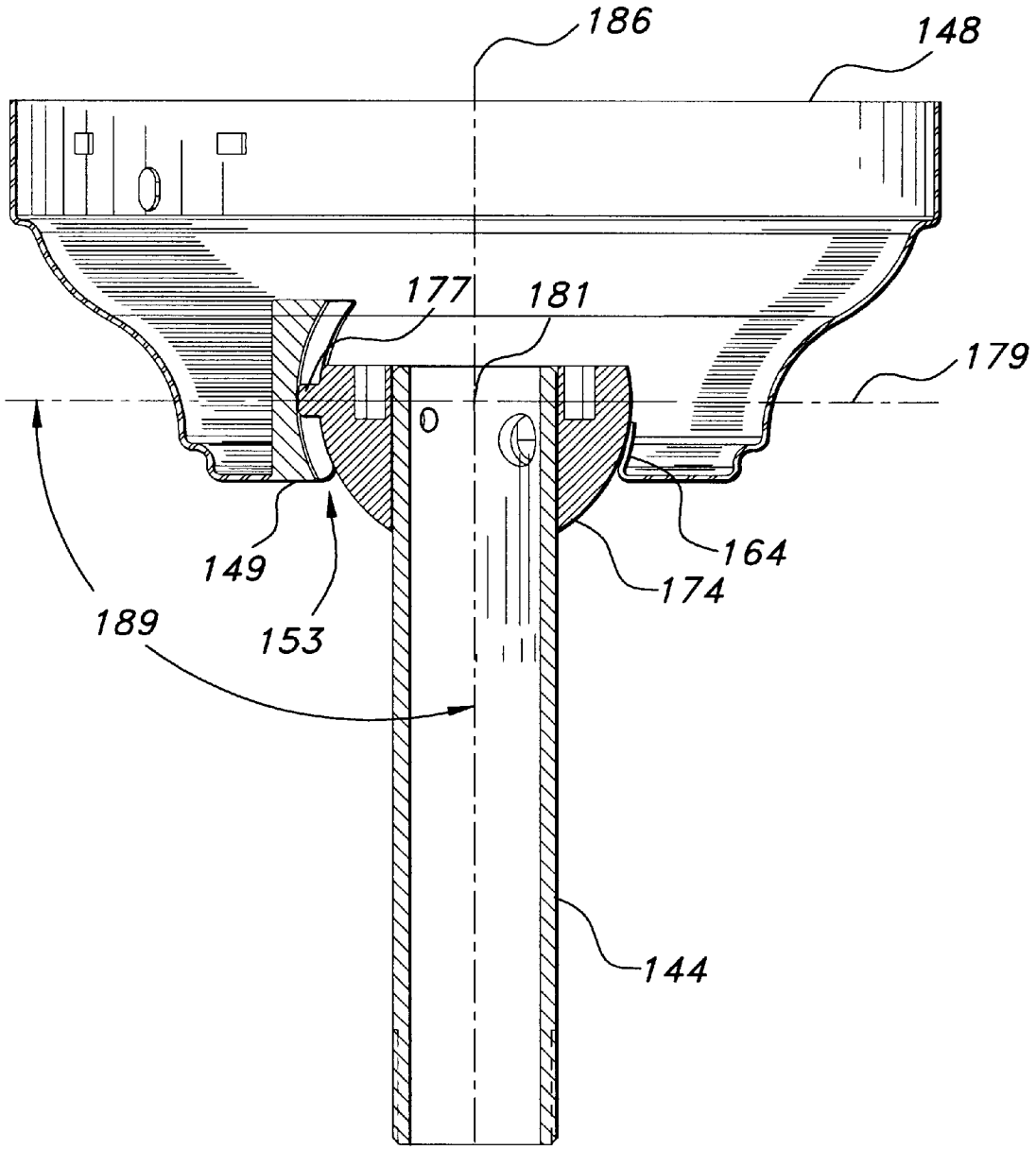
FIG. 9 is an elevation view, partially in cross-section, further illustrating the system for suspending the ceiling fan of the present invention, which is shown in FIG. 8.

Reference may also be made to FIG. 9, which illustrates that axis 179 and 177 is substantially perpendicular to the centerline axis 186 of ceiling fan 100, i.e., angle 189 is substantially 90 degrees. Also as shown in FIG. 9, axis 179 intersects the center 181 of the spherical outer surface 180 of ball 174. A plane ABCD is illustrated in FIGS. 22–24 which passes longitudinally through the center of downrod 144 and intersects the pivoting axis 179 of pin 177, which passes through ball 174. Both axis 179 and the centerline axis 186 of ceiling fan 100 lie in plane ABCD. Plane ABCD intersects the outer surface of the lower end 147 of downrod 144 at points I and J as shown in FIGS. 22–24, which illustrate the ball 174 in various positions relative to the canopy seat 164. The positions illustrated in FIGS. 22–24 correspond generally to those shown in FIGS. 5–7 for conventional ball 24 and seat 30 of canopy 18, for purposes of comparison. As shown in FIGS. 22–24, a line between points I and J, which may be referred to as line IJ, remains substantially parallel to axis 179 as ball 174 pivots within seat 164. Accordingly, there is no lateral displacement of points I and J as ball 174 pivots, i.e., dimensions "X" and "Y" shown in FIGS. 5 and 7 for conventional ball 24, do not exist with regard to ball 174. Accordingly, points I and J may remain in a substantially vertically disposed plane as ball 174 pivots as required within seat 164 of canopy 148 to accommodate a sloped ceiling and axis 186 of fan 100 is not canted relative to vertical due to the reaction of the torque of motor 112 of fan 100.

Utilization of the suspension system of the present invention is expected to result in smoother operation of the ceiling fan since the cyclical jerking of the fan, due to the reaction of the combination of fan motor torque and imbalance forces, experienced by fans using conventional ceiling fan systems, is eliminated. Furthermore, the inventors expect the magnitude of the fan wobble pattern to be significantly reduced relative to that which exists when using conventional ceiling fan suspension systems.

While the foregoing description has set forth the preferred embodiments of the present invention in particular detail, it must be understood that numerous modifications, substitutions and changes can be undertaken without departing from the true spirit and scope of the present invention as defined by the ensuing claims. For instance, the ball 174 may be directly connected to the downrod 144 of the ceiling fan 100, or to a similar structure. In this instance, the inner surface of ball 174 may be threaded, so that ball 174 may be threaded onto the upper end portion 146 of the downrod 144 of ceiling fan 100, having a similar thread, or to a similar structure of another ceiling fan. The invention is therefore not limited to a specific preferred embodiment as described, but is only limited as defined by the following claims.

What is claimed is:

1. A system for suspending a ceiling fan having a longitudinal centerline axis and a motor having a rotor and a stator, the ceiling fan further including a plurality of fan blades connected to the rotor, said system comprising:

a hollow canopy defining an interior space, said canopy including an upper end portion which is operatively attachable to a support structure and a lower end portion having a bottom surface, said canopy further including a seat connected to said lower end portion and extending upwardly from said lower end portion within said interior space, said seat having upper and lower ends, an outer surface and an inner surface defining an aperture extending through said seat and through said bottom surface of said lower end portion, said canopy further including a guide connected to and extending upwardly from said bottom surface within said interior space, said guide having an inner surface which forms a portion of said inner surface of said seat, said guide defining a receptacle which extends through said seat thereby subdividing said seat into two circumferentially extending portions, said receptacle extending through said bottom surface of said lower end portion of said canopy;

a ball pivotally engaged with said seat of said canopy and connected to a stationary portion of the ceiling fan for the purpose of suspending the ceiling fan, the ball including upper and lower ends, and inner and outer surfaces which define an annular wall extending between said upper and lower ends, said inner surface connected to the stationary portion of the ceiling fan, said outer surface engaging said inner surface of said seat of said canopy;

a pin attached to said ball and protruding radially outwardly from said outer surface of said ball, said pin being engaged in said receptacle of said guide of said canopy, said pin having a longitudinal centerline axis which extends through a center of said outer surface of said ball and is substantially perpendicular to the longitudinal centerline axis of the ceiling fan, said pin and said receptacle of said guide cooperating with one another to prevent the ball and the ceiling fan from rotating about the longitudinal centerline axis of the ceiling fan;

said outer surface of said ball having a shape which is complementary to a shape of said inner surface of said seat of said canopy, said outer surface of said ball and said inner surface of said seat interacting with one another to allow the ceiling fan to pivot about said longitudinal centerline axis of said pin.

2. The system as recited in claim 1, wherein:

said outer surface of said ball and said inner surface of said seat each have an arcuate shape.

3. The system as recited in claim 1, wherein:

said outer surface of said ball and said inner surface of said seat each comprises a spherical surface.

4. The system as recited in claim 1, wherein:

said pin and said ball comprise a one-piece construction.

5. The system as recited in claim 1, wherein:

said pin and said ball are made of a nylon material.

6. The system as recited in claim 1, wherein:

said inner surface of said guide has an arcuate shape.

7. The system as recited in claim 1, wherein:

said canopy further includes a central, body portion extending between said upper end portion and said lower end portion;

said seat and said guide of said canopy are integrally formed with said upper end portion, said lower end portion and said central, body portion of said canopy and comprise a one-piece construction thereof.

8. The system as recited in claim 7, wherein:

said canopy is made of a material selected from the group consisting of metals and metallic alloys.

9. The system as recited in claim 1, wherein:

said canopy further includes a central, body portion extending between said upper end portion and said lower end portion;

said seat and said guide of said canopy are manufactured separately from said upper end portion, said lower end portion and said central, body portion, and are then attached to said lower end portion.

10. The system as described in claim 9, wherein:

said upper end portion, said lower end portion and said central body portion of said canopy are made from a material selected from the group consisting of metals and metallic alloys.

11. The system as recited in claim 10, wherein:

said seat and said guide of said canopy are made from a molded plastic material.

12. The system as recited in claim 11, wherein:

said seat of said canopy and said guide of said canopy are bonded to said lower end portion of said canopy.

13. The system as recited in claim 1, wherein the ceiling fan further includes a downrod having an upper end and a lower end connected to the stationary portion of the ceiling fan, said system further comprising:

a hollow sleeve having open upper and lower ends, said sleeve being disposed in surrounding relationship with and connected to the upper end of the downrod, said sleeve having a substantially cylindrical inner surface and a tapered outer surface; wherein said ball is disposed in surrounding and contacting relationship with said sleeve, said inner surface of said ball defining an aperture extending through said ball which is effective for receiving said sleeve, said inner surface being configured to frictionally engage said tapered outer surface of said sleeve.

14. The system as recited in claim 13, wherein:

said inner surface of said ball and said outer surface of said hollow sleeve are tapered radially outwardly between said lower and upper ends of said ball and said hollow sleeve, respectively.

15. The system as recited in claim 14, wherein:

said ball includes a longitudinal centerline axis;

said inner surface of said ball has a radially outward taper extending from said lower to said upper end of said ball, ranging from about 1.0 degrees to about 15.0 degrees relative to said longitudinal centerline axis of said ball.

16. The system as recited in claim 15, wherein:

said taper of said inner surface of said ball is about 7.0 degrees.

17. The system as recited in claim 15, wherein:

said hollow sleeve includes a longitudinal centerline axis;

said outer surface of said hollow sleeve has a radially outward taper extending from said lower to said upper end of said sleeve, ranging from about 1.0 degrees to about 15.0 degrees relative to said longitudinal centerline axis of said sleeve.

18. The system as recited in claim 17, wherein:

said taper of said outer surface of said hollow sleeve is about 7.0 degrees.

19. The system as recited in claim 13, wherein the upper end of the downrod of the of ceiling fan includes a pair of diametrically opposed holes extending radially therethrough, said system further comprising:

a pin effective for connecting a hollow sleeve to the upper end of the downrod; wherein:

said inner and outer surfaces of said hollow sleeve define a wall extending therebetween;

said hollow sleeve includes a pair of diametrically opposed apertures extending through said walls;

said sleeve is positioned so that said apertures and said sleeve are aligned with the holes in the upper end of the downrod and said pin is inserted through said apertures in said hollow sleeve and the aligned holes in the upper end of the downrod, thereby connecting the hollow sleeve to the downrod.

20. The system as recited in claim 19, wherein:

said ball includes a pair of diametrically opposed slots formed in said annular wall of said ball and extending longitudinally from said upper end of said ball toward said lower end;

each of said slots being effective for receiving an end of said pin thereby permitting said ball to translate longitudinally relative to the downrod.

21. The system as recited in claim 20, wherein:

said hollow sleeve includes a slit which extends through said wall and longitudinally from said lower end of said sleeve to and through said upper end of said sleeve thereby subdividing said sleeve into first and second circumferentially extending portions and permitting said sleeve to conform to the upper end of the downrod.

22. The system as recited in claim 20, wherein:

said sleeve comprises a plurality of relief notches extending through said wall, said notches extending longitudinally from one of said ends of said sleeve and toward the other of said ends of said sleeve, said notches facilitating circumferential compression of said sleeve.

23. The system as recited in claim 20, wherein:

said sleeve includes a generally U-shaped relief notch extending through said wall and longitudinally from said upper end of said sleeve toward said lower end of said sleeve, said notch being spaced apart longitudinally from said lower end of said sleeve;

said ball includes a third slot formed in said annular wall and extending from said upper end of said ball toward said lower end of said ball;

said generally U-shaped relief notch of said sleeve is aligned with said third slot in said ball, wherein said generally U-shaped notch in said third slot are effective for receiving a means for grounding the ceiling fan, the means for grounding being attached to the upper end of the downrod.

24. The system as received in claim 19, further comprising:

a fastener threaded into said upper end of said ball;

said fastener including a head disposed in a recess formed in said upper end of said ball;

said head being sized so it radially overlaps said upper end of said hollow sleeve thereby preventing said hollow sleeve from passing through said upper end of said ball.

* * * * *